US008709992B2

(12) United States Patent
Barnabas et al.

(10) Patent No.: US 8,709,992 B2
(45) Date of Patent: Apr. 29, 2014

(54) FABRIC CARE COMPOSITIONS COMPRISING FRONT-END STABILITY AGENTS

(75) Inventors: Freddy Arthur Barnabas, West Chester, OH (US); Kristin Marie Finley, Milford, OH (US); Nathan Hall, Liberty Township, OH (US); Travis Kyle Hodgdon, Cincinnati, OH (US); Phillip Kyle Vinson, Fairfield, OH (US); Alessandro Corona, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 142 days.

(21) Appl. No.: 13/433,326

(22) Filed: Mar. 29, 2012

(65) Prior Publication Data

US 2012/0252716 A1 Oct. 4, 2012

Related U.S. Application Data

(60) Provisional application No. 61/469,140, filed on Mar. 30, 2011, provisional application No. 61/501,426, filed on Jun. 27, 2011.

(51) Int. Cl.
*C11D 1/83* (2006.01)
*C11D 1/86* (2006.01)

(52) U.S. Cl.
USPC ..... 510/527; 510/522

(58) Field of Classification Search
USPC ..... 510/522, 527
See application file for complete search history.

(56) References Cited

U.S. PATENT DOCUMENTS 4,081,384 A 3/1978 Pracht
4,137,180 A 1/1979 Naik et al.
4,214,038 A 7/1980 McCarty et al.
4,234,627 A 11/1980 Schilling
4,514,461 A 4/1985 Woo
4,597,898 A 7/1986 Vander Meer
4,659,802 A 4/1987 Rubingh et al.
4,661,288 A 4/1987 Rubingh et al.
4,676,921 A 6/1987 Vander Meer
RE32,713 E 7/1988 Woo
4,772,403 A * 9/1988 Grandmaire et al. ..... 510/526
4,882,220 A 11/1989 Ono et al.
4,891,160 A 1/1990 Vander Meer
4,917,920 A 4/1990 Ono et al.
5,145,842 A 9/1992 Driedger et al.
5,296,622 A 3/1994 Uphues et al.
5,500,137 A 3/1996 Bacon et al.
5,500,138 A 3/1996 Bacon et al.
5,500,154 A 3/1996 Bacon et al.
5,646,101 A 7/1997 MacBeath
5,686,014 A 11/1997 Baillely et al.
5,695,679 A 12/1997 Christie et al.
5,698,504 A 12/1997 Christie et al.
5,705,464 A 1/1998 Scheper et al.
5,710,115 A 1/1998 Patel et al.
5,747,443 A 5/1998 Wahl et al.
5,780,404 A 7/1998 Bacon et al.
6,020,303 A 2/2000 Cripe et al.
6,200,949 B1 3/2001 Reijmer et al.
6,211,140 B1 4/2001 Sivik et al.
6,491,728 B2 12/2002 Bacon et al.
6,620,904 B2 9/2003 Lemke
6,645,479 B1 11/2003 Shefer et al.
6,797,689 B2 9/2004 Eyres et al.
6,806,248 B2 10/2004 Grainger et al.
6,815,069 B2 11/2004 Hohberg et al.
6,849,592 B2 2/2005 Grainger et al.
6,992,059 B2 1/2006 Grainger et al.
7,119,057 B2 10/2006 Popplewell et al.
7,135,451 B2 11/2006 Corona, III et al.
7,153,924 B2 12/2006 Kuepfer et al.
7,321,019 B2 1/2008 Ziche
7,427,648 B2 9/2008 Ochs et al.
7,452,854 B2 11/2008 Green et al.
7,687,451 B2 3/2010 Green et al.
7,799,752 B2 9/2010 Ness et al.
2003/0158344 A1 8/2003 Rodriques et al.
2003/0165692 A1 9/2003 Koch et al.
2003/0195133 A1 10/2003 Shefer et al.
2003/0203829 A1 10/2003 Shefer et al.
2003/0215417 A1 11/2003 Uchiyama et al.
2003/0216488 A1 11/2003 Uchiyama et al.
2004/0071742 A1 4/2004 Popplewell et al.
2004/0071746 A1 4/2004 Popplewell et al.
2004/0072719 A1 4/2004 Bennett et al.
2004/0072720 A1 4/2004 Brain et al.
2004/0087477 A1 5/2004 Ness
2004/0106536 A1 6/2004 Mane et al.
2004/0204337 A1 10/2004 Corona, III et al.
2005/0202990 A1 9/2005 Caswell et al.
2006/0094639 A1 5/2006 Martin et al.
2006/0217288 A1 * 9/2006 Wahl et al. ..... 510/515
2006/0276370 A1 12/2006 Zhang et al.
2007/0099817 A1 5/2007 Smith et al.

(Continued)

FOREIGN PATENT DOCUMENTS

EP 0 394 133 A1 10/1990
WO WO 92/15745 A1 9/1992
WO WO 02/18528 A1 3/2002
WO WO 2009/150097 A1 12/2009
WO WO 2010/019727 A1 2/2010

OTHER PUBLICATIONS

International Search Report; International Application No. PCT/US2012/031071; date of mailing Jul. 3, 2012; 11 pages.

*Primary Examiner* — John Hardee
(74) *Attorney, Agent, or Firm* — James F. McBride; Steven W. Miller

(57) ABSTRACT

Fabric softening compositions comprising front-end stability agents exhibiting desirable viscosity profiles even when they contain polymeric delivery enhancing agents. Compositions comprising softening actives based on hardened tallow fatty acids are pumpable, pourable liquids and provide "low dose" fabric softeners for consumer use.

25 Claims, No Drawings

(56) References Cited

U.S. PATENT DOCUMENTS

| | | | | |
|---|---|---|---|---|
| 2007/0275866 | A1 | 11/2007 | Dykstra | |
| 2008/0242584 | A1 * | 10/2008 | Wahl et al. | 510/517 |
| 2008/0305982 | A1 | 12/2008 | Smets et al. | |
| 2009/0029899 | A1 | 1/2009 | Grainger et al. | |
| 2009/0247449 | A1 | 10/2009 | Burdis et al. | |
| 2010/0075890 | A1 | 3/2010 | Ford et al. | |
| 2010/0267601 | A1 | 10/2010 | Panandiker et al. | |
| 2010/0325812 | A1 | 12/2010 | Panandiker et al. | |
| 2011/0172137 | A1 | 7/2011 | Corominas et al. | |
| 2011/0245142 | A1 | 10/2011 | Gizaw et al. | |

* cited by examiner

FABRIC CARE COMPOSITIONS COMPRISING FRONT-END STABILITY AGENTS

CROSS REFERENCE TO RELATED APPLICATION

This application claims the benefit of U.S. Provisional Application Ser. No. 61/469,140, filed Mar. 30, 2011; and to U.S. 61/501,426, filed Jun. 27, 2011; all disclosures of which are incorporated herein by reference.

FIELD OF THE INVENTION

The present disclosure relates to through-the-rinse fabric care compositions comprising front-end stability agents and delivery enhancing agents and methods of using same to treat fabrics, especially in a laundering context.

BACKGROUND OF THE INVENTION

Formulating a fabric care composition at a desirable initial rheology and then maintaining this rheology over the lifetime of the fabric care composition is difficult. In particular, it is difficult to formulate a fabric care composition containing a delivery enhancing agent at a desirable initial rheology and to maintain this rheology over the lifetime of the fabric care product. Delivery enhancing agents are generally polymers that, alone or in combination with other polymers, significantly enhance the deposition of a fabric care benefit agent (e.g., fabric softener active, silicone, perfume) onto the fabric during laundering. It is known that low molecular weight delivery enhancing agents (less than about 2,000,000 Daltons) may cause phase instability. Moreover, high molecular weight delivery enhancing agents may significantly increase the viscosity of fabric care compositions, even when added at low levels.

There have been attempts to improve rheology stability over time in fabric care compositions. For example, the use of unsaturated and/or branched alcohols and fatty acids in certain fabric care compositions to address the problem of thickening of the composition upon storage is known. There have also been attempts to formulate fabric care compositions containing a delivery enhancing agent and various fabric care benefit agents to deliver improved feel and scent benefits. There is a need, however, to formulate a fabric care composition containing a high molecular weight delivery enhancing agent and a fabric care benefit agent at a desirable initial rheology and then to maintain this rheology over the lifetime of the fabric care product.

Importantly, the compositions herein exhibit an improved viscosity, which allows for the addition of desirable polymers. However, polymers that can be used as delivery enhancing agents can thicken the product excessively. Typically, the viscosity of a mix of fabric softening active and target levels of polymer, especially cross-linked polymer, would be too high for an acceptable consumer product. The compositions herein provide both improved performance and a desirable viscosity range.

SUMMARY OF THE INVENTION

The present invention solves one more of the needs by providing, in one aspect of the invention, a through-the-rinse fabric care composition comprising: a) from about 1.5 to about 50% by weight of the composition of a fabric softening active; b) from about 0.5% to about 6% by weight of the fabric softening active of a front-end stability agent selected from various stability agents disclosed hereinafter, and especially saturated branched alcohols having a carbon content of about 8 to about 20 carbon atoms or saturated branched carboxylic acids (including their salts) having a carbon content of about 8 to about 20 carbon atoms and mixtures thereof; and c) from about 0.01% to about 8%, by weight, of a delivery enhancing agent.

Other aspects of the invention include treating fabric with fabric care compositions comprising the front-end stability agent and delivery enhancing agent.

DETAILED DESCRIPTION OF THE INVENTION

As used herein, the articles "a" and "an" when used in the disclosure or in a claim, are understood to mean one or more of what is claimed or described.

As used herein, "front-end stability agent" means an agent that is added directly to a fabric softener active, before the fabric softener active is hydrated and before it is combined with the remaining components of the fabric softener composition (e.g., perfume, silicones, polymers).

As used herein, the terms "include," "includes," and "including" are meant to be non-limiting and are synonymous with "comprising."

Unless otherwise noted, all component or composition levels are in reference to the active portion of that component or composition, and are exclusive of impurities, for example, residual solvents or by-products, which may be present in commercially available sources of such components or compositions. All percentages, ratios or proportions are by weight of the total composition, unless otherwise specified.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Compositions

The fabric care compositions disclosed herein may comprise a fabric softening active, a front-end stability agent, and a delivery enhancing agent. Fabric care compositions in the liquid form are generally in an aqueous carrier, and generally have a pour viscosity from about 30 to about 500 mPas, or from about 50 to about 200 mPas, as measured at 25° C. using a Brookfield viscometer (Brookfield DV-E) with Spindle #62 at 60 rpm. Fabric care compositions also encompass low-water or "concentrated" formulations such as those containing water or other liquid carrier, but at levels less than about 50% (e.g., 1%-40%) or less than about 30% or less than about 20% water or other carrier.

Fabric Softening Active

Liquid fabric softener compositions (such as those comprising DOWNY)® comprise a fabric softening active. One class of fabric softening actives includes cationic surfactants. Liquid fabric softeners may be described as a concentrated polydispersion of particles made of cationic surfactant. The particles are spherical vesicles of cationic surfactant. The vesicles may act as carriers for perfumes. Imperfections in processing conditions and in softener active compositions can result in incomplete and/or undesirable vesicle formation, e.g., larger than desired vesicles or lamellar sheets. It is believed that these undesirable structures may contribute to high initial rheology, rheology growth with age (thickening upon storage so the fabric softener is no longer pourable), and/or physical instabilities. Without being bound by theory, it is believed that the addition of a front-end stability agent to the cationic surfactant, before the cationic surfactant is hydrated (i.e., is unhydrated), reduces the concentration of undesirable structures, such as large vesicles and lamellar sheets, and increases the concentration of desirable structures, such as small vesicles, thereby reducing the particle size distribution of the subsequently-formulated aqueous dispersion of said softening active (without increasing process energy). Smaller vesicles are believed to trap less water and thereby occupy less volume in the fabric softener, which reduces the viscosity of the fabric softener and increases space for other benefit agents, such as delivery enhancing agents.

It is believed that the front-end stability agent simultaneously increases the flexibility of the vesicles and destabilizes the edges of lamellar sheets, thereby reducing the initial rheology of the fabric softener and viscosity growth over time, while improving the physical stability of the softener. Thus, the addition of a front-end stability agent helps to offset the effects of processing and raw material variations, e.g., high initial rheology and rheology growth with age.

Examples of cationic surfactants useful as fabric softening actives include quaternary ammonium compounds. Exemplary quaternary ammonium compounds include alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof. A final fabric softening composition (suitable for retail sale) will comprise from about 1.5% to about 50%, alternatively from about 1.5% to about 30%, alternatively from about 10% to about 25%, alternatively from about 15 to about 21%, of fabric softening active by weight of the final composition. Fabric softening compositions, and components thereof, are generally described in US 2004/0204337. In one embodiment, the fabric softening composition is a so called "rinse added" composition. In such embodiment, the composition is substantially free of detersive surfactants, alternatively substantially free of anionic surfactants. In another embodiment, the pH of the fabric softening composition is acidic, for example between about pH 2 and about pH 5, alternatively between about pH 2 to about pH 4, alternatively between about pH 2 and about pH 3. The pH may be adjusted with the use of hydrochloric acid or formic acid.

In yet another embodiment, the fabric softening active is DEEDMAC (e.g., ditallowoyl ethanolester dimethyl ammonium chloride). DEEDMAC means mono and di-fatty acid ethanol ester dimethyl ammonium quaternaries, the reaction products of straight chain fatty acids, methyl esters and/or triglycerides (e.g., from animal and/or vegetable fats and oils such as tallow, palm oil and the like) and methyl diethanol amine to form the mono and di-ester compounds followed by quaternization with an alkylating agent.

In one aspect, the fabric softener active is a bis-(2-hydroxyethyl)-dimethylammonium chloride fatty acid ester having an average chain length of the fatty acid moieties of from 16 to 20 carbon atoms, preferably 16 to 18 carbon atoms, and an Iodine Value (IV), calculated for the free fatty acid, of from 15 to 25, alternatively from 18 to 22, alternatively from about 19 to about 21, alternatively combinations thereof. The Iodine Value is the amount of iodine in grams consumed by the reaction of the double bonds of 100 g of fatty acid, determined by the method of ISO 3961.

In some aspects, the fabric softening active comprises, as the principal active, compounds of the formula $$\{R_{4-m}—N^+—[(CH_2)_n—Y—R^1]_m\}A^- \quad (1)$$

wherein each R substituent is either hydrogen, a short chain $C_1$-$C_6$, preferably $C_1$-$C_3$ alkyl or hydroxyalkyl group, e.g., methyl, ethyl, propyl, hydroxyethyl, and the like, poly($C_{2-3}$ alkoxy), preferably polyethoxy, benzyl, or mixtures thereof; each m is 2 or 3; each n is from 1 to about 4, preferably 2; each Y is —O—(O)C—, —C(O)—O—, —NR—C(O)—, or —C(O)—NR—; the sum of carbons in each $R^1$, plus one when Y is —O—(O)C— or —NR—C(O)—, is $C_{12}$-$C_{22}$, preferably $C_{14}$-$C_{20}$, with each $R^1$ being a hydrocarbyl, or substituted hydrocarbyl group, and $A^-$ can be any softener-compatible anion, preferably, chloride, bromide, methylsulfate, ethylsulfate, sulfate, and nitrate, more preferably chloride or methyl sulfate;

In some aspects, the fabric softening active has the general formula:

$$[R_3N+CH_2CH(YR^1)(CH_2YR^1)]A^-$$

wherein each Y, R, $R^1$, and $A^-$ have the same meanings as before. Such compounds include those having the formula:

$$[CH_3]_3N^{(+)}[CH_2CH(CH_2O(O)CR^1)O(O)CR^1]Cl^{(-)} \quad (2)$$

wherein each R is a methyl or ethyl group and preferably each $R^1$ is in the range of $C_{15}$ to $C_{19}$. As used herein, when the diester is specified, it can include the monoester that is present.

These types of agents and general methods of making them are disclosed in U.S. Pat. No. 4,137,180, Naik et al., issued Jan. 30, 1979. An example of a preferred DEQA (2) is the "propyl" ester quaternary ammonium fabric softener active having the formula 1,2-di(acyloxy)-3-trimethylammoniopropane chloride.

In some aspects, the fabric softening active has the formula:

$$[R_{4-m}—N^+—R^1{}_m]A^- \quad (3)$$

wherein each R, $R^1$, and $A^-$ have the same meanings as before.

In some aspects, the fabric softening active has the formula:

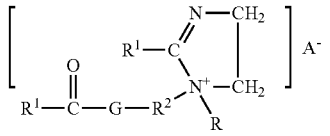

(4)

wherein each R, $R^1$, and $A^-$ have the definitions given above; each $R^2$ is a $C_{1-6}$ alkylene group, preferably an ethylene group; and G is an oxygen atom or an —NR— group;

In some aspects, the fabric softening active has the formula:

(5)

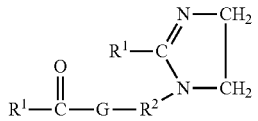

wherein $R^1$, $R^2$ and G are defined as above.

In some aspects, the fabric softening active is a condensation reaction product of fatty acids with dialkylenetriamines in, e.g., a molecular ratio of about 2:1, said reaction products containing compounds of the formula:

$$R^1—C(O)—NH—R^2—NH—R^3—NH—C(O)—R^1 \quad (6)$$

wherein $R^1$, $R^2$ are defined as above, and each $R^3$ is a $C_{1-6}$ alkylene group, preferably an ethylene group and wherein the reaction products may optionally be quaternized by the additional of an alkylating agent such as dimethyl sulfate. Such quaternized reaction products are described in additional detail in U.S. Pat. No. 5,296,622, issued Mar. 22, 1994 to Uphues et al.

In some aspects, the preferred fabric softening active has the formula:

$$[R^1—C(O)—NR—R^2—N(R)_2—R^3—NR—C(O)—R^1]^+A^- \quad (7)$$

wherein R, $R^1$, $R^2$, $R^3$ and $A^-$ are defined as above;

In some aspects, the fabric softening active is a reaction product of fatty acid with hydroxyalkylalkylenediamines in a molecular ratio of about 2:1, said reaction products containing compounds of the formula:

$$R^1—C(O)—NH—R^2—N(R^3OH)—C(O)—R^1 \quad (8)$$

wherein $R^1$, $R^2$ and $R^3$ are defined as above;

In some aspects, the fabric softening active has the formula:

(9)

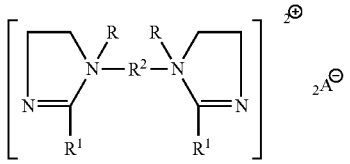

wherein R, $R^1$, $R^2$, and $A^-$ are defined as above.

Non-limiting examples of compound (1) are N,N-bis (stearoyl-oxy-ethyl) N,N-dimethyl ammonium chloride, N,N-bis(tallowoyl-oxy-ethyl) N,N-dimethyl ammonium chloride, N,N-bis(stearoyl-oxy-ethyl) N-(2 hydroxyethyl) N-methyl ammonium methylsulfate. Non-limiting examples of compound (2) is 1,2 di(stearoyl-oxy) 3 trimethyl ammoniumpropane chloride.

Non-limiting examples of Compound (3) are dialkylenedimethylammonium salts such as dicanoladimethylammonium chloride, di(hard)tallowedimethylammonium chloride dicanoladimethylammonium methylsulfate. An example of commercially available dialkylenedimethylammonium salts usable in the present invention is dioleyldimethylammonium chloride available from Witco Corporation under the trade name Adogen® 472 and dihardtallow dimethylammonium chloride available from Akzo Nobel Arquad 2HT75.

A non-limiting example of Compound (4) is 1-methyl-1-stearoylamidoethyl-2-stearoylimidazolinium methylsulfate wherein $R^1$ is an acyclic aliphatic $C_{15}$-$C_{17}$ hydrocarbon group, $R^2$ is an ethylene group, G is a NH group, $R^5$ is a methyl group and $A^-$ is a methyl sulfate anion, available commercially from the Witco Corporation under the trade name Varisoft®.

A non-limiting example of Compound (5) is 1-tallowylamidoethyl-2-tallowylimidazoline wherein $R^1$ is an acyclic aliphatic $C_{15}$-$C_{17}$ hydrocarbon group, $R^2$ is an ethylene group, and G is a NH group.

A non-limiting example of Compound (6) is the reaction products of fatty acids with diethylenetriamine in a molecular ratio of about 2:1, said reaction product mixture containing N,N"-dialkyldiethylenetriamine with the formula:

$$R^1—C(O)—NH—CH_2CH_2—NH—CH_2CH_2—NH—C(O)—R^1$$

wherein $R^1$—C(O) is an alkyl group of a commercially available fatty acid derived from a vegetable or animal source, such as Emersol® 223LL or Emersol® 7021, available from Henkel Corporation, and $R^2$ and $R^3$ are divalent ethylene groups.

A non-limiting example of Compound (7) is a difatty amidoamine based softener having the formula:

$$[R^1—C(O)—NH—CH_2CH_2—N(CH_3)(CH_2CH_2OH)—CH_2CH_2—NH—C(O)—R^1]^+ CH_3SO_4^-$$

wherein $R^1$—C(O) is an alkyl group, available commercially from the Witco Corporation e.g. under the trade name Varisoft® 222LT.

An example of Compound (8) is the reaction products of fatty acids with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$—C(O) is an alkyl group of a commercially available fatty acid derived from a vegetable or animal source, such as Emersol® 223LL or Emersol® 7021, available from Henkel Corporation.

An example of Compound (9) is the diquaternary compound having the formula:

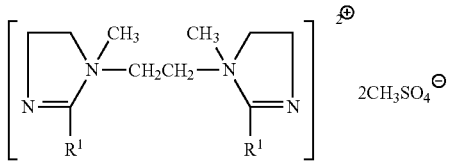

wherein $R^1$ is derived from fatty acid, and the compound is available from Witco Company. It will be understood that combinations of softener actives disclosed above are suitable for use in this invention.

Anion A

In the cationic nitrogenous salts herein, the anion $A^-$, which is any softener compatible anion, provides electrical neutrality. Most often, the anion used to provide electrical neutrality in these salts is from a strong acid, especially a halide, such as chloride, bromide, or iodide. However, other anions can be used, such as methylsulfate, ethylsulfate, acetate, formate, sulfate, carbonate, and the like. Chloride and methylsulfate are preferred herein as anion A. The anion can also, but less preferably, carry a double charge in which case $A^-$ represents half a group.

Front-End Stability Agent

The fabric care compositions of the present invention comprise a front-end stability agent selected from saturated or unsaturated branched alcohols comprising 8 to 20 carbon atoms or saturated or unsaturated carboxylic acids (or salt) comprising 8 to 20 carbon atoms.

In some aspects, the front-end stability agent is selected from a saturated branched alcohol or a saturated branched carboxylic acid (or salt thereof), each having a chain length of 8 to 20 carbon atoms, or mixtures thereof.

In some aspects, the front-end stability agent is represented by the following formula:

$$R'R''CH(CH_2)_nA$$

wherein n=0 to 3; A=—OH or —COOR'''; R' & R''=C2 to C12 alkyl or alkenyl group, preferably for a total of 8 to 20 carbon atoms, wherein R''' is hydrogen or a cation, such as sodium, potassium, ammonium, or the like (i.e., salt of the acid). Fatty acid alkyl esters are not preferred stability agents herein since they are believed not to be sufficiently polar. However, hydroxyalkyl esters (e.g., hydroxymethyl) may be useful.

A suitable front-end stability agent is typically any saturated branched alcohol or saturated carboxylic acid that has the desired chain length, which could arise from mixed feeds into an aldol condensation or Guerbet reaction. For example, suitable saturated branched alcohols include 2-ethyl-1-hexanol, 2-ethyl-1-heptanol, 2-ethyl-1-octanol, 2-ethyl-1-nonanol, 2-ethyl-1-decanol, 2-ethyl-1-undecanol, 2-ethyl-1-dodecanol, 2-propyl-1-hexanol, 2-propyl-1-heptanol, 2-propyl-1-octanol, 2-propyl-1-nonanol, 2-propyl-1-decanol, 2-propyl-1-undecanol, 2-propyl-1-dodecanol, 2-butyl-1-hexanol, 2-butyl-1-heptanol, 2-butyl-1-octanol (e.g., Isofol® 12), 2-butyl-1-nonanol, 2-butyl-1-decanol, 2-butyl-1-undecanol, 2-butyl-1-dodecanol, 2-pentyl-1-hexanol, 2-pentyl-1-heptanol, 2-pentyl-1-octanol, 2-pentyl-1-nonanol, 2-pentyl-1-decanol, 2-pentyl-1-undecanol, 2-pentyl-1-dodecanol, 2-hexyl-1-heptanol, 2-hexyl-1-octanol, 2-hexyl-1-nonanol, 2-hexyl-1-decanol (e.g., Isofol® 16), 2-hexyl-1-undecanol, 2-hexyl-1-dodecanol, 2-heptyl-1-octanol, 2-heptyl-1-nonanol, 2-heptyl-1-decanol, 2-heptyl-1-undecanol, 2-heptyl-1-dodecanol, 2-octyl-1-hexanol, 2-octyl-1-nonanol, 2-octyl-1-decanol, 2-octyl-1-undecanol, 2-octyl-1-dodecanol (e.g., Isofol® 20), a mixture of branched C16-17 alcohols (e.g., Neodol® 67) (see U.S. Pat. No. 6,020,303), iso-stearyl alcohol with branching on the second carbon (e.g., Fineoxocol® 180), a mixture of 2-octyldecanol and 2-hexyldodecanol (Isofol® 18E), and a mixture of branched C12-13 alcohols (e.g., Isalchem® 123) and mixtures thereof. The iso-stearyl alcohol with branching on the second carbon may have the following structure (Fineoxocol® 180):

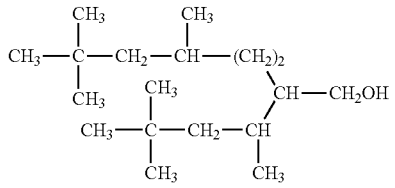

In certain aspects, the front-end stability agent is selected from saturated branched alcohols having a chain length of 8 to 20 carbon atoms. Suitable saturated branched alcohols having a chain length of 8 to 20 carbon atoms include 2-ethyl-1-hexanol, 2-butyl-1-octanol, 2-hexyl-1-decanol, 2-octyl-1-decanol, 2-octyl-1-dodecanol, a mixture of branched C16-17 alcohols, iso-stearyl alcohol with branching on the second carbon, a mixture of branched C12-13 alcohols, and mixtures thereof. In some embodiments, the front end stability agent is selected from 2-hexyl-1-decanol, 2-butyl-1-octanol, and mixtures thereof.

In certain aspects, the front-end stability agent is selected from saturated branched alcohols having a chain length of 12 to 20 carbon atoms. Suitable saturated branched alcohols having a chain length of 12 to 20 carbon atoms include 2-butyl-1-octanol, 2-hexyl-1-decanol, 2-octyl-1-decanol, 2-octyl-1-dodecanol, a mixture of branched C16-17 alcohols, iso-stearyl alcohol with branching on the second carbon, a mixture of branched C12-13 alcohols, and mixtures thereof. In some embodiments, the front end stability agent is selected from 2-hexyl-1-decanol, 2-butyl-1-octanol, and mixtures thereof.

Suitable saturated branched carboxylic acids (including their salts and mixtures thereof) include 2-ethyl-1-hexanoic acid, 2-ethyl-1-heptanoic acid, 2-ethyl-1-octanoic acid, 2-ethyl-1-nonanoic acid, 2-ethyl-1-decanoic acid, 2-ethyl-1-undecanoic acid, 2-ethyl-1-dodecanoic acid, 2-propyl-1-hexanoic acid, 2-propyl-1-heptanoic acid, 2-propyl-1-octanoic acid, 2-propyl-1-nonanoic acid, 2-propyl-1-decanoic acid, 2-propyl-1-undecanoic acid, 2-propyl-1-dodecanoic acid, 2-butyl-1-hexanoic acid, 2-butyl-1-heptanoic acid, 2-butyl-1-octanoic acid (Isocarb® 12), 2-butyl-1-nonanoic acid, 2-butyl-1-decanoic acid, 2-butyl-1-undecanoic acid, 2-butyl-1-dodecanoic acid, 2-pentyl-1-hexanoic acid, 2-pentyl-1-heptanoic acid, 2-pentyl-1-octanoic acid, 2-pentyl-1-nonanoic acid, 2-pentyl-1-decanoic acid, 2-pentyl-1-undecanoic acid, 2-pentyl-1-dodecanoic acid, 2-hexyl-1-heptanoic acid, 2-hexyl-1-octanoic acid, 2-hexyl-1-nonanoic acid, 2-hexyl-1-decanoic acid (Isocarb® 16), 2-hexyl-1-undecanoic acid, 2-hexyl-1-dodecanoic acid, 2-heptyl-1-octanoic acid, 2-heptyl-1-nonanoic acid, 2-heptyl-1-decanoic acid, 2-heptyl-1-undecanoic acid, 2-heptyl-1-dodecanoic acid, 2-octyl-1-hexanoic acid, 2-octyl-1-nonanoic acid, 2-octyl-1-decanoic acid (Isocarb® 18), 2-octyl-1-undecanoic acid, 2-octyl-1-dodecanoic acid (Isocarb® 20) and mixtures thereof.

In certain aspects, the front-end stability agent is selected from branched, preferably saturated carboxylic acids comprising 12 to 20 carbon atoms. Suitable saturated carboxylic acids comprising 12 to 20 carbon atoms include 2-hexyl-1-decanoic acid, 2-butyl-1-octanoic acid, and mixtures thereof. In some embodiments, the front end stability agent is 2-hexyl-1-decanoic acid. Again, salts, especially water-soluble salts such as sodium, potassium and ammonium salts, of said acids are understood to be included among said stability agents.

In some aspects, the fabric care composition of the invention comprises a front-end stability agent wherein the concentration of front-end stability agent is about 0.5% to about 6% by weight of the fabric softener active. In certain embodiments, the fabric care composition of the invention comprises a front-end stability agent wherein the concentration of front-end stability agent is about 0.5% to about 4% by weight of the fabric softener active. In further embodiments, the fabric care composition of the invention comprises a front-end stability agent wherein the concentration of front-end stability agent is about 0.5% to about 2% by weight of the fabric softener active, alternatively from about 0.5% to about 1.5% by weight of the fabric softener active.

In some aspects, a fabric care composition of the invention comprises a fabric softener active and a front-end stability agent, where the front-end stability agent is selected from 2-propyl-1-heptanol, 2-ethyl-1-hexanol, 2-butyl-1-octanol, 2-hexyl-1-decanol, 2-octyl-1-decanol, 2-octyl-1-dodecanol, a mixture of branched C16-17 alcohols, iso-stearyl alcohol with branching on the second carbon, a mixture of branched C12-13 alcohols, 2-hexyl-1-decanoic acid, and mixtures thereof, where the front-end stability agent is present at about 0.5% to about 3% by weight of the fabric softener active.

Delivery Enhancing Agent

The compositions may comprise from about 0.01% to about 8% of the composition of a "delivery enhancing agent." As used herein, such term refers to any polymer or combination of polymers that significantly enhance the deposition of the fabric care benefit agent onto the fabric during laundering. In certain embodiments, the fabric care composition of the invention comprises from about 0.1% to about 5% by weight of the composition of a delivery enhancing agent. In further embodiments, the fabric care composition of the invention comprises from about 0.2% to about 3% by weight of the composition of a delivery enhancing agent.

In some aspects, the delivery enhancing agent may be a cationic or amphoteric polymer. The cationic charge density of the polymer ranges from about 0.05 milliequivalents/g to about 23 milliequivalents/g. The charge density may be calculated by dividing the number of net charge per repeating unit by the molecular weight of the repeating unit. In one aspect, the charge density varies from about 0.05 milliequivalents/g to about 8 milliequivalents/g. The positive charges could be on the backbone of the polymers or the side chains of polymers. For polymers with amine monomers, the charge density depends on the pH of the carrier. For these polymers, charge density may be measured at a pH of 7. Non-limiting examples of deposition enhancing agents are cationic or amphoteric polymers, polysaccharides, proteins and synthetic polymers. Cationic polysaccharides include cationic cellulose derivatives, cationic guar gum derivatives, chitosan and derivatives and cationic starches. Cationic polysaccharides have a weight average molecular weight from about 50,000 to about 2 million, preferably from about 100,000 to about 1,500,000. Suitable cationic polysaccharides include cationic cellulose ethers, particularly cationic hydroxyethylcellulose and cationic hydroxypropylcellulose. Examples of cationic hydroxyalkyl cellulose include those with the INCI name Polyquaternium10 such as those sold under the trade names Ucare Polymer JR 30M, JR 400, JR 125, LR 400 and LK 400 polymers; Polyquaternium 67 such as those sold under the trade name Softcat SK™, all of which are marketed by Amerchol Corporation, Edgewater N.J.; and Polyquaternium 4 such as those sold under the trade name Celquat H200 and Celquat L-200 available from National Starch and Chemical Company, Bridgewater, N.J. Other suitable polysaccharides include Hydroxyethyl cellulose or hydroxypropylcellulose quaternized with glycidyl $C_{12}$-$C_{22}$ alkyl dimethyl ammonium chloride. Examples of such polysaccharides include the polymers with the INCI names Polyquaternium 24 such as those sold under the trade name Quaternium LM 200 by Amerchol Corporation, Edgewater N.J. Cationic starches described by D. B. Solarek in Modified Starches, Properties and Uses published by CRC Press (1986) and in U.S. Pat. No. 7,135,451, col. 2, line 33—col. 4, line 67. Cationic galactomannans include cationic guar gums or cationic locust bean gum. An example of a cationic guar gum is a quaternary ammonium derivative of Hydroxypropyl Guar such as those sold under the trade name Jaguar C13 and Jaguar Excel available from Rhodia, Inc of Cranbury N.J. and N-Hance by Aqualon, Wilmington, Del.

In one aspect, a synthetic cationic polymer may be used as the delivery enhancing agent. The weight-average molecular weight of these polymers may be in the range of from about 2000 to about 5 million, in some aspects from about 3000 to about 10 million. Synthetic polymers include synthetic addition polymers of the general structure

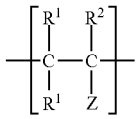

wherein each $R^1$ may be independently hydrogen, $C_1$-$C_{12}$ alkyl, substituted or unsubstituted phenyl, substituted or unsubstituted benzyl, —$OR_a$, or —$C(O)OR_a$ wherein $R_a$ may be selected from the group consisting of hydrogen, $C_1$-$C_{24}$ alkyl, and combinations thereof. In one aspect, $R^1$ may be hydrogen, $C_1$-$C_4$ alkyl, or —$OR_a$, or —$C(O)OR_a$ wherein each $R^2$ may be independently selected from the group consisting of hydrogen, hydroxyl, halogen, $C_1$-$C_{12}$ alkyl, —$OR_a$, substituted or unsubstituted phenyl, substituted or unsubstituted benzyl, carbocyclic, heterocyclic, and combinations thereof. In one aspect, $R^2$ may be selected from the group consisting of hydrogen, $C_1$-$C_4$ alkyl, and combinations thereof.

Each Z may be independently hydrogen, halogen; linear or branched $C_1$-$C_{30}$ alkyl, nitrilo, $N(R^3)_2$—$C(O)N(R^3)_2$; —NHCHO (formamide); —$OR^3$, —$O(CH_2)_nN(R^3)_2$, —$O(CH_2)_nN^+(R^3)_3X^-$, —$C(O)OR^4$; —$C(O)N$—$(R^3)_2$; —$C(O)O(CH_2)_nN(R^3)_2$, —$C(O)O(CH_2)_nN^+(R^3)_3X^-$, $(CH_2)_nN(R^3)_2$, —$OCO(CH_2)_nN^+(R^3)_3X^-$, —$C(O)NH$—$(CH_2)_nN(R^3)_2$, —$C(O)NH(CH_2)_nN^+(R^3)_3X^-$, —$(CH_2)_nN(R^3)_2$, —$(CH_2)_nN^+(R^3)_3X^-$, Each $R^3$ may be independently selected from the group consisting of hydrogen, $C_1$-$C_{24}$ alkyl, $C_2$-$C_8$ hydroxyalkyl, benzyl, substituted benzyl, and combinations thereof;

Each $R^4$ may be independently selected from the group consisting of hydrogen, $C_1$-$C_{24}$ alkyl,

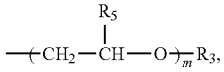

and combinations thereof, wherein m is 1-10.

X may be a water soluble anion wherein n may be from about 1 to about 6.

$R_5$ may be independently selected from the group consisting of hydrogen, $C_1$-$C_6$ alkyl, and combinations thereof.

Z may also be selected from the group consisting of non-aromatic nitrogen heterocycles containing a quaternary ammonium ion, heterocycles containing an N-oxide moiety, aromatic nitrogens containing heterocyclic wherein one or more or the nitrogen atoms may be quaternized; aromatic nitrogen-containing heterocycles wherein at least one nitrogen may be an N-oxide; and combinations thereof. Non-limiting examples of addition polymerizing monomers comprising a heterocyclic Z unit includes 1-vinyl-2-pyrrolidinone, 1-vinylimidazole, quaternized vinyl imidazole, 2-vinyl-1,3-dioxolane, 4-vinyl-1-cyclohexene-1, 2-epoxide, and 2-vinylpyridine, 2-vinylpyridine N-oxide, 4-vinylpyridine 4-vinylpyridine N-oxide.

A non-limiting example of a Z unit which can be made to form a cationic charge in situ may be the —NHCHO unit, formamide. The formulator can prepare a polymer or copolymer comprising formamide units some of which are subsequently hydrolyzed to form vinyl amine equivalents.

The polymers or co-polymers may also contain one or more cyclic polymer units derived from cyclically polymerizing monomers. An example of a cyclically polymerizing monomer is dimethyl diallyl ammonium having the formula:

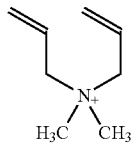

Suitable copolymers may be made from one or more cationic monomers selected from the group consisting of N,N-dialkylaminoalkyl methacrylate, N,N-dialkylaminoalkyl acrylate, N,N-dialkylaminoalkyl acrylamide, N,N-dialkylaminoalkylmethacrylamide, quaternized N,N-dialkylaminoalkyl methacrylate, quaternized N,N-dialkylaminoalkyl acrylate, quaternized N,N-dialkylaminoalkyl acrylamide, quaternized N,N-dialkylaminoalkylmethacrylamide, vinylamine and its derivatives, allylamine and its derivatives, vinyl imidazole, quaternized vinyl imidazole and diallyl dialkyl ammonium chloride and combinations thereof, and optionally a second monomer selected from the group consisting of acrylamide, N,N-dialkyl acrylamide, methacrylamide, N,N-dialkylmethacrylamide, $C_1$-$C_{12}$ alkyl acrylate, $C_1$-$C_{12}$ hydroxyalkyl acrylate, polyalkylene glyol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole and derivatives, acrylic acid, methacrylic acid, maleic acid, vinyl sulfonic acid, styrene sulfonic acid, acrylamidopropylmethane sulfonic acid (AMPS) and their salts, and combinations thereof. The polymer may optionally be cross-linked. Suitable crosslinking monomers include ethylene glycoldiacrylate, divinylbenzene, butadiene.

In one aspect, the synthetic polymers are poly(acrylamide-co-diallyldimethylammonium chloride), poly(acrylamide-methacrylamidopropyltrimethyl ammonium chloride), poly (acrylamide-co-N,N-dimethyl aminoethyl methacrylate), poly(acrylamide-co-N,N-dimethyl aminoethyl acrylate), poly(hydroxyethylacrylate-co-dimethyl aminoethyl methacrylate), poly(hydroxpropylacrylate-co-dimethyl aminoethyl methacrylate), poly(hydroxpropylacrylate-co-methacrylamidopropyltrimethylammonium chloride), poly (acrylamide-co-diallyldimethylammonium chloride-co-acrylic acid), poly(acrylamide-methacrylamidopropyltrimethyl ammonium chloride-co-acrylic acid). Examples of other suitable synthetic polymers are Polyquaternium-1, Polyquaternium-5, Polyquaternium-6, Polyquaternium-7, Polyquaternium-8, Polyquaternium-11, Polyquaternium-14, Polyquaternium-22, Polyquaternium-28, Polyquaternium-30, Polyquaternium-32 and Polyquaternium-33. Other cationic polymers include polyethyleneamine and its derivatives and polyamidoamine-epichlorohydrin (PAE) Resins. In one aspect, the polyethylene derivative may be an amide derivative of polyetheylenimine sold under the trade name Lupasol® SK. Also included are alkoxylated polyethlenimine; alkyl polyethyleneimine and quaternized polyethyleneimine. These polymers are described in Wet Strength resins and their applications edited by L. L. Chan, TAPPI Press (1994). The weight-average molecular weight of the polymer will generally be from about 10,000 to about 5,000,000, or from about 100,000 to about 200,000, or from about 200,000 to about 1,500,000, as determined by size exclusion chromatography relative to polyethylene oxide standards with RI detection. The mobile phase used is a solution of 20% methanol in 0.4M MEA, 0.1 M $NaNO_3$, 3% acetic acid on a Waters Linear Ultrandyrogel column, 2 in series. Columns and detectors are kept at 40° C. Flow is set to 0.5 ml/min.

In another aspect, the delivery enhancing agent may comprise poly(acrylamide-N-dimethyl aminoethyl acrylate) and its quaternized derivatives. In this aspect, the delivery enhancing agent may be that sold under the trade name Sedipur®, available from BTC Specialty Chemicals, a BASF Group, Florham Park, N.J. In one embodiment, the delivery enhancing agent is cationic acrylic based homopolymer sold under the trade name Rheovis CDE, from BASF. See also US 2006/0094639; U.S. Pat. No. 7,687,451; U.S. Pat. No. 7,452,854.

In another aspect, the delivery enhancing agent may comprise at least one polymer formed from the polymerisation of a) a water soluble ethylenically unsaturated monomer or blend of monomers comprising at least one cationic monomer and at least one non-ionic monomer;

wherein the cationic monomer is a compound according to formula (I):

(I)

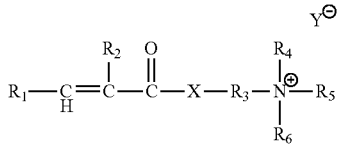

wherein:

$R_1$ is chosen from hydrogen or methyl, preferably hydrogen;

$R_2$ is chosen hydrogen, or $C_1$-$C_4$ alkyl, preferably hydrogen;

$R_3$ is chosen $C_1$-$C_4$ alkylene, preferably ethylene;

$R_4$, $R_5$, and $R_6$ are each independently chosen from hydrogen, or $C_1$-$C_4$ alkyl, preferably methyl;

X is chosen from —O—, or —NH—, preferably —O—; and

Y is chosen from Cl, Br, I, hydrogensulfate, or methosulfate, preferably Cl.

wherein the non-ionic monomer is a compound of formula (II):

(II)

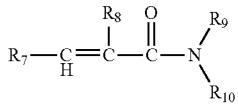

wherein:

$R_7$ is chosen from hydrogen or methyl, preferably hydrogen;

$R_8$ is chosen from hydrogen or $C_1$-$C_4$ alkyl, preferably hydrogen; and $R_9$ and $R_{10}$ are each independently chosen from hydrogen or $C_1$-$C_4$ alkyl, preferably methyl, b) at least one cross-linking agent in an amount from 0.5 ppm to 1000 ppm by the weight of component a), and c) at least one chain transfer agent in the amount of greater than 10 ppm relative to component a), preferably from 1200 ppm to 10,000 ppm, more preferably from 1,500 ppm to 3,000 ppm (as described in the U.S. Patent Application Ser. No. 61/469,140, filed Mar. 30, 2011, claiming the benefit of Provisional Application No. 61/320,032).

Embodiments Comprising One or More Fatty Amphiphiles

In one aspect, the fabric care compositions disclosed herein may be fluid fabric enhancers that comprise the aforementioned fabric softening active, front-end stability agent, delivery enhancing agent, and optionally one or more fatty amphiphiles.

In one aspect, a fluid fabric softener comprising a composition that comprises, based on total fluid fabric softener weight, from about 2% to about 25%, from about 3% to about 15% or even from about 3% to about 7% of one or more cationic fabric softening actives; and from about 2% to about 20%, from about 3% to about 16% or even from about 3% to about 10% of one or more fatty amphiphiles comprising one or more $C_{10}$-$C_{22}$ moieties, $C_{16}$-$C_{20}$ moieties, or $C_{16}$-$C_{18}$ moieties; composition having at least one melt transition temperature, two melt transition temperatures or even three melt transition temperatures that are at least 3° C., from 3° C. to about 20° C., from about 5° C. to about 15° C., or even from about 5° C. to about 12° C. higher than the melt transition temperature of individual dispersions of any cationic fabric softening active or amphiphile that is employed in said fluid fabric softener and a previously mentioned combination of front-end stability agent and delivery enhancing agent, is disclosed.

In one aspect of said fluid fabric softener, said cationic fabric softener active may be selected from the group consisting of: linear quaternary ammonium compounds, branched quaternary ammonium compounds, cyclic quaternary ammonium compounds and mixtures thereof; said quaternary ammonium compounds comprising:

one or more $C_{10}$-$C_{22}$ fatty acid moieties, $C_{16}$-$C_{20}$ fatty acid moieties, or $C_{16}$-$C_{18}$ fatty acid moieties, said fatty acid moieties having an Iodine value from 0 to about 95, 0 to about 60, or 15 to about 55;

a counter ion, in one aspect, said counter ion is selected from the group consisting of chloride, bromide, methylsulfate, ethylsulfate, sulfate, and nitrate, in one aspect, said counter ion is selected from the group consisting of chloride, methyl sulphate; and one or more moieties selected from the group consisting of alkyl moieties, ester moieties, amide moieties, and ether moieties said one or more moieties being covalently bound to the nitrogen of said quaternary ammonium compound.

In one aspect of said fluid fabric softener, said cationic fabric softening active may be selected from the group consisting of: an ester quaternary ammonium compound, in one aspect, said ester quaternary ammonium compound is selected from the group consisting of N,N-bis(stearoyl-oxy-ethyl) N,N-dimethyl ammonium chloride, N,N-bis(tallowoyl-oxy-ethyl) N,N-dimethyl ammonium chloride, N,N-bis(stearoyl-oxy-ethyl) N-(2 hydroxyethyl) N-methyl ammonium methylsulfate, N,N-bis(stearoyl-oxy-ethyl) N,N-diisopropyl ammonium methylsulfate, N,N-bis(tallowoyl-oxy-ethyl) N,N-diisopropyl ammonium methylsulfate, and mixtures thereof; an alkylated quaternary ammonium compound, in one aspect, said alkylated quaternary ammonium compound is selected from the group consisting of dicanoladimethylammonium chloride, di(hard)tallowedimethylammonium chloride, distearyldimethylammonium chloride, dicanoladimethylammonium methylsulfate, dioleyldimethylammonium chloride and mixtures thereof; an alkoxylated quaternary ammonium compound, in one aspect, said alkoxylated quaternary ammonium compound is selected from the group consisting of ethoxylated coco alkylbis(hydroxyethyl) methyl quaternary ammonium chloride, alkyl polyglycol ether ammonium methylchloride and mixtures thereof; and mixtures thereof.

In one aspect of said fluid fabric softener, said amphiphile may comprises one or more moieties selected from the group consisting of an alcohol moiety, an ester moiety, an amide moiety and mixtures thereof.

In one aspect of said fluid fabric softener, said amphiphile may be selected from the group consisting of: a fatty alcohol, in one aspect said fatty alcohol may be selected from the group comprising lauryl alcohol, cetyl alcohol, stearyl alcohol, behenyl alcohol and mixtures thereof; an alkoxylated fatty alcohol, in one aspect said alkoxylated fatty alcohol may be selected from the group consisting of polyoxyethylene lauryl ether, polyoxyethylene cetyl ether, polyoxyethylene stearyl ether, polyoxyethylene behenyl ether and mixtures thereof, in one aspect, said alkoxylated fatty alcohol's polyoxyethylene moiety comprises from about 2 to about 150, from about 5 to about 100, or from about 10 to about 50 ethylene oxide moieties; a fatty ester, in one aspect, said fatty esters may be selected from the group consisting of:

(i) a glyceride, in one aspect, said glycerides may be selected from the group consisting of monoglycerides, diglycerides, triglycerides and mixtures thereof. In one aspect, said glycerides may comprise fatty acid ester moieties comprising carbon chains having a carbon chain length of from about 10 to about 22 carbon atoms (ii) a sorbitan ester, in one aspect, said sorbitan ester may be selected from the group consisting of polyoxyethylene sorbitan monostearate, polyoxyethylene sorbitan monooleate, polyoxyethylene sorbitan monopalmitate, polyoxyethylene sorbitan monolaurate and mixtures thereof, in one aspect, said sorbitan ester's polyoxyethylene moiety may comprise from 2 to about 150, from about 5 to about 100, or from about 10 to about 50 ethylene oxide moieties;

a poly(glycerol ester), in one aspect, said poly(glycerol ester) may be selected from the group consisting poly(glycerol esters) having the following formula

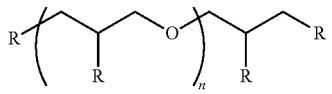

wherein each R is independently selected from the group consisting of fatty acid ester moieties comprising carbon chains, said carbon chains having a carbon chain length of from about 10 to about 22 carbon atoms; —OH; and combinations thereof;

wherein n is from 1.5 to about 10 with the provisos that: when n is from about 1.5 to about 6, the average % esterification of said polyglycerol ester is from about 20% to about 100%; when n is from about 1.5 to about 5, the average % esterification is from about 20% to about 90%; when n is from about 1.5 to about 4, the average % esterification is from about 20% to about 80%; and more than about 50% of said polyglycerol ester in said composition has at least two ester linkages and mixtures thereof; and mixtures of said fatty alcohol, alkoxylated fatty alcohol, fatty ester and poly(glycerol esters.

In one aspect of said fluid fabric softener, said fluid fabric softener may comprise, based on total composition weight, from about 0% to about 0.75%, from about 0% to about 0.5%, from about 0.01% to about 0.2%, from about 0.02% to about 0.1% or even from about 0.03% to about 0.075% of a salt. In one aspect of said fluid fabric softener, said salt may be selected from the group consisting of sodium chloride, potassium chloride, calcium chloride, magnesium chloride and mixtures thereof.

Exemplary Fatty Amphiphiles

Suitable fatty amphiphiles, include, but are not limited to, polyglycerol esters. Polyglycerol esters ("PGEs") are known. See, for example, U.S. Pat. No. 4,214,038 and US 2006/0276370. PGEs are esters typically obtained by reacting polyglycerol and a fatty acid. Polyglycerol esters may be prepared from glycerin as described in the literature, for example, as described in U.S. Pat. No. 6,620,904. In general, oligomerization of the glycerol unit is an intermolecular reaction between two glycerin molecules to form a diglycerol. Two such oligomers can also be reacted together, or an oligomer can be reacted with an additional glycerin to form yet higher oligomers. Polyglycerols may be converted to polyglycerol esters by typical esterification techniques for example, via reaction with fatty acids, fatty acid chlorides, and the like. The fatty acids used in the esterification can be a mixture of fatty acid chain lengths such as, for example, the fatty acid mixtures derived from coconut oil or tallow. The fatty acids may be saturated or unsaturated, and may contain from about 12 to about 22 carbon atoms, or about 10 to 22 carbon atoms. The fatty acid mixtures derived from natural fats and oils such as, for example, rapeseed oil, peanut oil, lard, tallow, coconut oil, palm oil, soybean oil can be converted to saturated form by hydrogenation, such processes being readily understood by one of ordinary skill in the art.

The PGE described herein generally comprises a mixture of polyglycerol esters, wherein each polyglycerol ester in the mixture of polyglycerol esters has the structure of Formula I:

Formula I

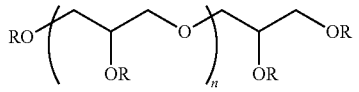

wherein each R is independently selected from the group consisting of fatty acid ester moieties comprising carbon chains having a carbon chain length of from about 10 to about 22 carbon atoms; OH; and combinations thereof;

wherein the mixture of polyglycerol esters has an average value of n ranging from about 1.5 to about 6;

wherein the mixture of polyglycerol esters has an average % esterification ranging from about 20% to about 100%;

wherein greater than or equal to about 50% of the polyglycerol esters in the mixture of polyglycerol esters have at least two ester linkages.

In one aspect, the PGE may be saturated (having an iodine value of about 0 to about 20) or unsaturated (having an iodine value of about 45 to about 135), or may comprise combinations thereof. For example, in one aspect, the PGEs of the compositions have an IV range of from about 40 to about 140; alternatively from about 35 to about 65, alternatively from about 40 to about 60; alternatively from about 1 to about 60, alternatively from about 15 to about 30, alternatively from about 15 to about 25. Further, while it may be acceptable to use cationic fabric softening active compounds with a melt transition temperature from about −50° C. to about 100° C., in one aspect, the disclosed PGEs may have a melt transition temperature of equal to or less than about 55° C.

In one aspect, the fatty acid carbon chain length may be from about 10 to 22, or about 12 to 18 or about 16 to 18 carbon atoms.

In one aspect, n, for Formula I above, may be about 1.5 to about 6, or about 1.5 to about 3.5 or about 1.5 to about 4.5 or about 1.5 to about 5.

In one aspect, the composition may comprise a PGE of Formula I wherein each R is independently selected from the group consisting of fatty acid ester moieties comprising carbon chains, said carbon chains having a carbon chain length of from about 10 to about 22 carbon atoms; OH; and combinations thereof;

wherein a) when n may be from about 1.5 to about 6, the average % esterification of the PGE may be from about 20% to about 100%;

b) when n may be from about 1.5 to about 5, the average % esterification may be from about 20% to about 90% c) when n may be from about 1.5 to about 4, the average % esterification may be from about 20% to about 80%;

wherein more than about 50% of the PGE mixture has at least two ester linkages.

In another aspect, the composition may comprise a PGE of Formula I wherein the fatty acid moieties' carbon chains have an average chain length of from about 10 to about 22 carbon atoms;

wherein the PGE has an iodine value of about 0 to about 145;

wherein a) when n may be from about 3 to about 6, the % esterification may be from about 20% to about 100%;

b) when n may be from about 3 to about 6, the % esterification may be from about 25% to about 90%; and c) when n may be from about 3 to about 6, the % esterification may be from about 35% to about 90%.

In yet another aspect, the composition may comprise a PGE of Formula I wherein the fatty acid moieties' carbon chains have an average carbon chain length of about 16 to 18 carbon atoms;

wherein the PGE has an iodine value of from about 0 to about 20;

wherein a) when n may be from about 1.5 to about 3.5, the % esterification may be from about 20% to about 60%;

b) when n may be from about 1.5 to about 4.5, the % esterification may be from about 20% to about 70%; and c) when n may be from about 1.5 to about 6, the % esterification may be from about 20% to about 80%.

In yet another aspect, the composition may comprise a PGE of Formula I wherein the fatty acid moieties' carbon chains have an average carbon chain length of from about 16 to about 18 carbon atoms;

wherein the PGE has an iodine value of about 18 to about 135; and wherein a) when n may be from about 1.5 to about 3, the % esterification may be from about 70% to about 100%;

b) when n may be from about 1.5 to about 4.5, the % esterification may be from about 50% to 100%; and c) when n may be from about 1.5 to about 6, the % esterification may be from about 25% to 60%.

In a yet further aspect, the composition may comprise a PGE of Formula I, wherein a) when n may be from about 3 to about 6, the % esterification may be from about 15% to about 100%;

b) when n may be from about 3 to about 6, the % esterification may be from about 25% to about 90%;

c) when n may be from about 3 to about 6, the % esterification may be from about 35% to about 90%.

Exemplary commercially available PGEs include Mazol® PGO 31K, Mazol® PGO 104K from BASF; Caprol® MPGO, Caprol® ET from Abitec Corp.; Grindsted® PGE 382, Grindsted® PGE 55, Grindsted® PGE 60 from Danisco; Varonic® 14, TegoSoft® PC 31, Isolan® GO 33, Isolan® GI 34 from Evonik Industries.

In one aspect, the composition may comprise a PGE of Formula I wherein the fatty acid moieties' carbon chains have an average carbon chain length of about 12 to 18 carbon atoms and an iodine value of about 0 to about 145, and when n may be from about 1.5 to about 6, the % esterification may be from about 20% to 80%.

In another aspect, the composition may comprise a PGE having the structure of Formula I, wherein each R may be independently selected from the group consisting of fatty acids having carbon chain lengths of about 12 to 18 carbon atoms, fatty acid moieties having carbon chain lengths of about 15 to 18 carbon atoms, OH, and mixtures thereof; wherein the fatty acid may be selected from the group consisting of saturated fatty acids, unsaturated fatty acids, and combinations thereof.

In one aspect, the fatty acid may be saturated, having an IV of about 0 to about 20.

In one aspect, the fatty acid may be branched, linear, or further functionalized, for example, by modification such that the fatty acid contains one or more hydroxyl groups.

In one aspect, at least 50%, or at least 75%, of the PGE molecules comprise at least two ester linkages.

The degree of oligomerization which is represented by "n" is generally understood to be an average representing a distribution of oligomers. While applicants have recognized that the number of polyglycerol units may be as large as greater than about 10, such molecules have decreased biodegradability and are therefore disfavored. The structure of Formula I is intended to include both linear and/or branched structures. The control of the degree and distribution of oligomers may be controlled to some extent by either physical means (e.g., distillation) or by varying the reaction conditions, as described in U.S. Pat. No. 6,620,904.

In another aspect, the PGEs may further comprise one or more cyclic polyglycerol ("CPG"). In addition to the above oligomerization reaction, an equivalent intramolecular reaction can occur within an oligomer to for a cyclic analog to the oligomer. The formation of cyclic groups reduces the number of free OH groups relative to non-cyclics. The % cyclic, as used herein, indicates the percent of PGE's having a cyclic group. Applicants have observed that as chain length increases, biodegradability of the PGE decreases. Without intending to be limited by theory, applicants believe that the decrease in biodegradability could be attributed to either the increase in oligomerization itself, or rather, to the increase in cyclic structures that are prone to occur as oligomerization may be increased, or to a combination of both.

In one aspect, the mixture of polyglycerol esters may comprise, based on total weight, from about 5% to about 70%, or from about 10% to about 50%, or from about 15% to about 30% of a cyclic polyglycerol.

In one aspect, the final fabric softening composition may comprise, based on total weight of the composition, from about 2% to about 50%, or from about 2% to about 40%, or from about 3% to about 30%, or from about 2% to about 30% of a mixture of PGEs. Alternatively the final fabric softening composition may comprise, based on total weight of the composition, from about from about 4% to about 40% of a mixture of PGEs.

In one aspect, the composition may comprise a PGE comprising a diester. In one aspect, the PGE may comprise, based on total weight of the PGE, from about 50% to about 100% of a diester. In yet another aspect, the PGEs of the instant composition comprise a diester, a triester, a tetraester, a hexaester or an octaester, for example, greater than about 50% of a diester, a triester, a tetraester, pentaester, a hexaester, a heptaester, or an octaester, or combinations thereof.

In one aspect, the PGE may comprise, based on total weight of the PGE, from about 50% to 100%, or from about 75% to about 90%, of an ester linkage selected from the group consisting of a diester, a triester, a tetraester, a hexaester, a heptaester, an octaester, and combinations thereof.

In a yet further aspect, from about 1% to about 50% or from about 5% to about 20% or less than about 10% of the PGE may comprise a monoester.

Other Components

The disclosed compositions may optionally include additional adjunct components. The following is a non-limiting list of suitable adjunct components.

Silicones

One aspect of the invention provides for fabric care compositions comprising a silicone. The term silicone is used herein in the broadest sense to include a silicone or silicone comprising compound that imparts a desirable benefit to fabric (upon using a fabric care composition of the present invention). "Silicone" preferably refers to emulsified and/or microemulsified silicones, including those that are commercially available and those that are emulsified and/or microemulsified in the composition, unless otherwise described.

In one aspect, the silicone is a polydialkylsilicone, alternatively a polydimethyl silicone (polydimethyl siloxane or "PDMS"), or a derivative thereof. In another embodiment, the silicone is chosen from an aminofunctional silicone, alkyloxylated silicone, ethoxylated silicone, propoxylated silicone, ethoxylated/propoxylated silicone, quaternary silicone, or combinations thereof. Levels of silicone in the fabric care composition may include from about 0.01% to about 20%, alternatively from about 0.1% to about 10%, alternatively from about 0.25% to about 5%, alternatively from about 0.4% to about 3%, alternatively from about 1% to about 5%, alternatively from about 1% to about 4%, alternatively from about 2% to about 3%, by weight of the fabric care composition.

Some non-limiting examples of silicones that are useful in the present invention include aminofunctional silicones as disclosed in the US application claiming the benefit of Provisional Application No. 61/221,670.

Some non-limiting examples of silicones that are useful in the present invention are: non-volatile silicone fluids such as polydimethyl siloxane gums and fluids; volatile silicone fluid which can be a cyclic silicone fluid of the formula $[(CH_3)_2SiO]_n$ where n ranges between about 3 to about 7, preferably about 5, or a linear silicone polymer fluid having the formula $(CH_3)_3SiO[(CH_3)_2SiO]_mSi(CH_3)_3$ where m can be 0 or greater and has an average value such that the viscosity at 25° C. of the silicone fluid is preferably about 5 centistokes or less.

One type of silicone that may be useful in the composition of the present invention is polyalkyl silicone with the following structure:

$$A\text{-}(Si(R_2)\text{—}O\text{—}[Si(R_2)\text{—}O\text{—}]_q\text{—}Si(R_2)\text{-}A$$

The alkyl groups substituted on the siloxane chain (R) or at the ends of the siloxane chains (A) can have any structure as long as the resulting silicones remain fluid at room temperature.

Each R group preferably is alkyl, hydroxy, or hydroxyalkyl group, and mixtures thereof, having less than about 8, preferably less than about 6 carbon atoms, more preferably, each R group is methyl, ethyl, propyl, hydroxy group, and mixtures thereof. Most preferably, each R group is methyl. Aryl, alkylaryl and/or arylalkyl groups are not preferred. Each A group which blocks the ends of the silicone chain is hydrogen, methyl, methoxy, ethoxy, hydroxy, propoxy, and mixtures thereof, preferably methyl. q is preferably an integer from about 7 to about 8,000.

One type of silicones include polydimethyl siloxanes and preferably those polydimethyl siloxanes having a viscosity of from about 10 to about 1000,000 centistokes at 25° C. Mixtures of volatile silicones and non-volatile polydimethyl siloxanes are also preferred. Preferably, the silicones are hydrophobic, non-irritating, non-toxic, and not otherwise harmful when applied to fabric or when they come in contact with human skin. Further, the silicones are compatible with other components of the composition are chemically stable under normal use and storage conditions and are capable of being deposited on fabric.

Other useful silicone materials, may include materials of the formula:

$$HO\text{—}[Si(CH_3)_2\text{—}O]_x\text{—}\{Si(OH)[(CH_2)_3\text{—}NH\text{—}(CH_2)_2\text{—}NH_2]O\}_y\text{—}H$$

wherein x and y are integers which depend on the molecular weight of the silicone, preferably having a viscosity of from about 10,000 cst to about 500,000 cst at 25° C. This material is also known as "amodimethicone". Although silicones with a high number, e.g., greater than about 0.5 millimolar equivalent of amine groups can be used, they are not preferred because they can cause fabric yellowing.

Similarly, silicone materials which may be used correspond to the formulas:

$$(R^1)_aG_{3-a}\text{-}Si\text{—}(\text{—}OSiG_2)_n\text{-}(OSiG_b(R^1)_{2-b})_m\text{—}O\text{—}SiG_{3-a}(R^1)_a$$

wherein G is selected from the group consisting of hydrogen, OH, and/or $C_1$-$C_5$ alkyl; a denotes 0 or an integer from 1 to 3; b denotes 0 or 1; the sum of n+m is a number from 1 to about 2,000; $R^1$ is a monovalent radical of formula $CpH_{2p}$ L in which p is an integer from 2 to 4 and L is selected from the group consisting of:

a) $\text{—}N(R^2)CH_2\text{—}CH_2\text{—}N(R^2)_2$;

b) $\text{—}N(R^2)_2$;

c) $\text{—}N^+(R^2)_3A^-$; and d) $\text{—}N^+(R^2)CH_2\text{—}CH_2N+H_2A^-$ wherein each $R^2$ is chosen from the group consisting of hydrogen, a $C_1$-$C_5$ saturated hydrocarbon radical, and each $A^-$ denotes compatible anion, e.g., a halide ion; and $$R^3\text{—}N+(CH_3)_2\text{—}Z\text{—}[Si(CH_3)_2O]_f\text{—}Si(CH_3)_2\text{—}Z\text{—}N+(CH_3)_2\text{—}R^3.2CH_3COO^-$$

wherein a) z=—$CH_2$—CH(OH)—$CH_2O$—$CH_2)_2$— b) $R^3$ denotes a long chain alkyl group; and c) f denotes an integer of at least about 2.

In the formulas herein, each definition is applied individually and averages are included.

Another silicone material may include those of the following formula:

$$(CH_3)_3\text{—}Si\text{—}[OSi(CH_3)_2]_n\text{—}\{\text{—}O\text{—}Si(CH_3)[(CH_2)_3\text{—}NH\text{—}(CH_2)_2\text{—}NH_2]\}_mOSi(CH_3)_3$$

wherein n and m are the same as before. The preferred silicones of this type are those which do not cause fabric discoloration.

Further non-limiting examples of silicones that are useful in the present invention include silicone polyethers with urethane as disclosed in the U.S. publication of Ser. No. 12/752,860.

In one aspect, the silicone is an organosiloxane polymer. Non-limiting examples of such silicones include those described in U.S. Pat. Nos. 6,815,069; 7,153,924; 7,321,019; and 7,427,648.

Alternatively, the silicone material can be provided as a moiety or a part of a non-silicone molecule. Examples of such materials are copolymers containing silicone moieties, typically present as block and/or graft copolymers.

Perfumes

One aspect of the invention provides for fabric care compositions comprising a perfume. As used herein the term "perfume" is used to indicate any odoriferous material that is subsequently released into the aqueous bath and/or onto fabrics contacted therewith. The perfume will most often be liquid at ambient temperatures. A wide variety of chemicals are known for perfume uses, including materials such as aldehydes, ketones, and esters. More commonly, naturally occurring plant and animal oils and exudates comprising complex mixtures of various chemical components are known for use as perfumes. The perfumes herein can be relatively simple in their compositions or can comprise highly sophisticated complex mixtures of natural and synthetic chemical components, all chosen to provide any desired odor. Examples of perfumes are described, for example, in US 2005/0202990 A1, from paragraphs 47 to 81. Examples of neat perfumes are disclosed in U.S. Pat. Nos. 5,500,138; 5,500,154; 6,491,728; 5,500,137 and 5,780,404. Perfume fixatives and/or perfume carrier materials may also be included. US 2005/0202990 A1, from paragraphs 82-139. Suitable perfume delivery systems, methods of making certain perfume delivery systems and the uses of such perfume delivery systems are disclosed in USPA 2007/0275866 A1. In one preferred embodiment, the fabric care composition comprises from about 0.01% to about 5%, alternatively from about 0.5% to about 3%, or from about 0.5% to about 2%, or from about 1% to about 2% neat perfume by weight of the fabric care composition.

In one aspect, the compositions of the present invention comprises perfume oil encapsulated in a perfume microcapsule (PMC), preferable a friable PMC. Suitable perfume microcapsules may include those described in the following references: US 2003-215417 A 1; US 2003-216488 A1; US 2003-158344 A1; US 2003-165692 A1; US 2004-071742 A1; US 2004-071746 A1; US 2004-072719 A1; US 2004-072720 A1; EP 1393706 A1; US 2003-203829 A1; US 2003-195133 A1; US 2004-087477 A1; US 2004-0106536 A1; US 2008-0305982 A1; US 2009-0247449 A1; U.S. Pat. No. 6,645,479; U.S. Pat. No. 6,200,949; U.S. Pat. No. 5,145,842; U.S. Pat. No. 4,882,220; U.S. Pat. No. 4,917,920; U.S. Pat. No. 4,514,461; U.S. Pat. No. 4,234,627; U.S. Pat. No. 4,081,384; U.S. RE 32713; U.S. Pat. No. 4,234,627; U.S. Pat. No. 7,119,057. In another aspect, the perfume microcapsule comprises a friable microcapsule. In another aspect, the shell comprising an aminoplast copolymer, esp. melamine-formaldehyde or urea-formaldehyde or cross-linked melamine formaldehyde or the like. Capsules may be obtained from Appleton Papers Inc., of Appleton, Wis. USA. Formaldehyde scavengers may also be used.

Fatty Acids

The compositions may optionally contain from about 0.01% to about 10%, or from about 2% to about 7%, or from about 3% to about 5%, by weight the composition, of a fatty acid, wherein, in one aspect, the fatty acid may comprise from about 8 to about 20 carbon atoms. Such typically unbranched fatty acids are non-front end stability agents, as described above. Such "adjunct" fatty acids may be present as part of the fabric softener active and may provide fabric lubricity benefits. The fatty acid may comprise from about 1 to about 10 ethylene oxide units in the hydrocarbon chain. Suitable fatty acids may be saturated and/or unsaturated and can be obtained from natural sources such a plant or animal esters (e.g., palm kernel oil, palm oil, coconut oil, babassu oil, safflower oil, tall oil, castor oil, tallow and fish oils, grease, or mixtures thereof), or synthetically prepared (e.g., via the oxidation of petroleum or by hydrogenation of carbon monoxide via the Fisher Tropsch process). Examples of suitable saturated fatty acids for use in the compositions include capric, lauric, myristic, palmitic, stearic, arachidic and behenic acid. Suitable unsaturated fatty acid species include: palmitoleic, oleic, linoleic, linolenic and ricinoleic acid. Examples of fatty acids are saturated C12 fatty acid, saturated C12-C14 fatty acids, and saturated or unsaturated C12 to C18 fatty acids, and mixtures thereof.

Dispersants

The compositions may contain from about 0.1%, to about 10%, by weight of dispersants. Suitable water-soluble organic materials are the homo- or co-polymeric acids or their salts, in which the polycarboxylic acid may contain at least two carboxyl radicals separated from each other by not more than two carbon atoms. The dispersants may also be alkoxylated derivatives of polyamines, and/or quaternized derivatives thereof such as those described in U.S. Pat. Nos. 4,597,898, 4,676,921, 4,891,160, 4,659,802 and 4,661,288.

The dispersants may also be materials according to Formula (I):

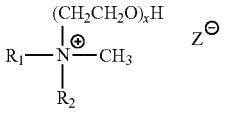

wherein $R_1$ is C6 to C22 alkyl, branched or unbranched, alternatively C12 to C18 alkyl, branched or unbranched. $R_2$ is nil, methyl, or $—(CH_2CH_20)_y$, wherein y is from 2 to 20. When R2 is nil, the Nitrogen will be protonated. x is also from 2 to 20. Z is a suitable anionic counterion, preferably selected from the group consisting of chloride, bromide, methylsulfate, ethylsulfate, sulfate, and nitrate, more preferably chloride or methyl sulfate.

In one embodiment, the dispersant is according to Formula (II):

(II)

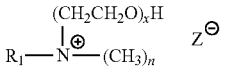

wherein x is from 2 to 20, and wherein $R_1$ is C6 to C22 alkyl, branched or unbranched, preferably C12 to C18 alkyl, branched or unbranched, and wherein n is 1 or 2. When n is 2, there is an anion. Z is a suitable anionic counterion, preferably selected from the group consisting of chloride, bromide, methylsulfate, ethylsulfate, sulfate, and nitrate, more preferably chloride or methyl sulfate. When n is 1, there is no anion present under acidic conditions. An example of such a material is alkyl polyglycol ether ammonium methylchloride sold under the product name, for example, Berol 648 from Akzo Nobel.

In another aspect, the dispersant is one according to Formula (III):

Formula (III)

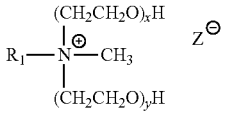

wherein x and y are each independently selection from 2 to 20, and wherein $R_1$ is C6 to C22 alkyl, branched or unbranched, preferably unbranched. In one embodiment, X+Y is from 2 to 40, preferably from 10 to 20. Z is a suitable anionic counterion, preferably chloride or methyl sulfate. An example of such a material is cocoalkylmethyl ethoxylated ammonium chloride sold under the product name, for example, ETHOQUAD C 25 from Akzo Nobel.

Another aspect of the invention provides for a method of making a perfumed fabric care composition comprising the step of adding the concentrated perfume composition of the present invention to a composition comprising one or more fabric softening actives, wherein preferably the composition comprising the fabric softening active is free or substantially free of a perfume.

The concentrated perfume composition is combined with the composition comprising fabric softening active(s) such that the final fabric softener composition comprises at least 1.5%, alternatively at least 1.7%, or 1.9%, or 2%, or 2.1%, or 2.3%, or 2.5%, or 2.7% or 3%, or from 1.5% to 3.5%, or combinations thereof, by weight of the final fabric softener composition.

The perfumed fabric care composition comprises a weight ratio of perfume to amphiphile of at least 3 to 1, alternatively 4:1, or 5:1, or 6:1, or 7:1, or 8:1, or 9:1, or 10:1, alternatively not greater than 100:1, respectively.

Structurants

Compositions of the present invention may contain a structurant or structuring agent. Suitable levels of this component are in the range from about 0.01% to 10%, preferably from 0.01% to 5%, and even more preferably from 0.01% to 3% by weight of the composition. The structurant serves to stabilize silicone polymers and perfume microcapsules in the inventive compositions and to prevent it from coagulating and/or creaming. This is especially important when the inventive compositions have fluid form, as in the case of liquid or the gel-form fabric enhancer compositions.

Structurants suitable for use herein can be selected from gums and other similar polysaccharides, for example gellan gum, carrageenan gum, xanthan gum, Diutan gum (ex. CP Kelco) and other known types of structurants such as Rheovis CDE (ex. BASF), Alcogum L-520 (ex. Alco Chemical), and Sepigel 305 (ex. SEPPIC).

One preferred structurant is a crystalline, hydroxyl-containing stabilizing agent, more preferably still, a trihydroxystearin, hydrogenated oil or a derivative thereof.

Without intending to be limited by theory, the crystalline, hydroxyl-containing stabilizing agent is a non-limiting example of a "thread-like structuring system" ("thread-like structuring systems" are described in detail in Solomon, M. J. and Spicer, P. T., "Microstructural Regimes of Colloidal Rod Suspensions, Gels, and Glasses," Soft Matter (2010)). "Thread-like Structuring System" as used herein means a system comprising one or more agents that are capable of providing a physical network that reduces the tendency of materials with which they are combined to coalesce and/or phase split. Examples of the one or more agents include crystalline, hydroxyl-containing stabilizing agents and/or hydrogenated jojoba. Surfactants are not included within the definition of the thread-like structuring system. Without wishing to be bound by theory, it is believed that the thread-like structuring system forms a fibrous or entangled thread-like network. The thread-like structuring system has an average aspect ratio of from 1.5:1, preferably from at least 10:1, to 200:1.

The thread-like structuring system can be made to have a viscosity of 0.002 $m^2/s$ (2,000 centistokes at 20° C.) or less at an intermediate shear range (5 $s^{-1}$ to 50 $s^{-1}$) which allows for the pouring of the fabric enhancer composition out of a standard bottle, while the low shear viscosity of the product at 0.1 $s^{-1}$ can be at least 0.002 $m^2/s$ (2,000 centistokes at 20° C.) but more preferably greater than 0.02 $m^2/s$ (20,000 centistokes at 20° C.). A process for the preparation of a thread-like structuring system is disclosed in WO 02/18528.

Other preferred structurants are uncharged, neutral polysaccharides, gums, celluloses, and polymers like polyvinyl alcohol, polyacrylamides, polyacrylates and co-polymers, and the like.

Dye Transfer Inhibiting Agents

The compositions may also include from about 0.0001%, from about 0.01%, from about 0.05% by weight of the compositions to about 10%, about 2%, or even about 1% by weight of the compositions of one or more dye transfer inhibiting agents such as polyvinylpyrrolidone polymers, polyamine N-oxide polymers, copolymers of N-vinylpyrrolidone and N-vinylimidazole, polyvinyloxazolidones and polyvinylimidazoles or mixtures thereof.

Chelant

The compositions may contain less than about 5%, or from about 0.01% to about 3% of a chelant such as citrates; nitrogen-containing, P-free aminocarboxylates such as ethylenediamine disuccinate (EDDS), ethylenediaminetetraacetic acid (EDTA), and diethylene triamine pentaacetic acid (DTPA); aminophosphonates such as diethylenetriamine pentamethylenephosphonic acid and, ethylenediamine tetramethylenephosphonic acid; nitrogen-free phosphonates e.g., HEDP; and nitrogen or oxygen containing, P-free carboxylate-free chelants such as compounds of the general class of certain macrocyclic N-ligands such as those known for use in bleach catalyst systems.

Brighteners

The compositions may also comprise a brightener (also referred to as "optical brightener") and may include any compound that exhibits fluorescence, including compounds that absorb UV light and reemit as "blue" visible light. Non-limiting examples of useful brighteners include: derivatives of stilbene or 4,4'-diaminostilbene, biphenyl, five-membered heterocycles such as triazoles, pyrazolines, oxazoles, imidiazoles, etc., or six-membered heterocycles (coumarins, naphthalamide, s-triazine, etc.). Cationic, anionic, nonionic, amphoteric and zwitterionic brighteners can be used. Suitable brighteners include those commercially marketed under the trade name Tinopal-UNPA-GX® by Ciba Specialty Chemicals Corporation (High Point, N.C.).

Other Components

Examples of other suitable, optional adjunct components include alkoxylated benzoic acids or salts thereof such as trimethoxy benzoic acid or a salt thereof (TMBA); zwitterionic and/or amphoteric surfactants; enzyme stabilizing systems; coating or encapsulating agents including polyvinylalcohol film or other suitable variations, carboxymethylcellulose, cellulose derivatives, starch, modified starch, sugars, PEG, waxes, or combinations thereof; soil release polymers; suds suppressors; dyes; colorants; salts such as sodium sulfate, calcium chloride, sodium chloride, magnesium chloride; photoactivators; hydrolyzable surfactants; preservatives; anti-oxidants; anti-shrinkage agents; other anti-wrinkle agents; germicides; fungicides; color speckles; colored beads, spheres or extrudates; sunscreens; fluorinated compounds; clays; pearlescent agents; luminescent agents or chemiluminescent agents; anti-corrosion and/or appliance protectant agents; alkalinity sources or other pH adjusting agents; solubilizing agents; processing aids; pigments; free radical scavengers, and combinations thereof. Suitable adjunct materials include those further disclosed hereinafter and in U.S. Pat. Nos. 5,705,464, 5,710,115, 5,698,504, 5,695,679, 5,686,014 and 5,646,101.

Process of Making Liquid Fabric Care Compositions

One advantage of the present invention is that the compositions herein can be prepared using essentially any type of high shear mixing that is used to make traditional liquid fabric softeners having an aqueous carrier. The following are non-limiting examples of the preparation of the compositions of the invention.

Broadly speaking, a method of making a fabric care composition herein comprises the steps of:

a. mixing a molten fabric softening active with a front end stability agent and optionally a fatty amphiphilie to form a first mixture;
b. combining the first mixture with acidified water and a delivery enhancing agent; and
c. optionally, adding one or more adjunct agents to said composition.

In more detail, in a typical manufacturing process the melted mixture of fabric softening active and front-end stability agent, optionally but preferably with minor amounts, e.g., 1-5%, of ethanol, isopropanol or mixtures thereof, is subjected to high shear mixing. The softener active is hydrated with acidified water and salt (e.g., $CaCl_2$) is added. The cross-linked polymer that functions as the delivery enhancing agent is combined with the hydrated softening active. Various adjunct agents such as perfumes, encapsulated perfumes, chelators, preservatives, etc., can be added in any step. An acidic system is preferably maintained throughout the process (e.g., using HCl) to minimize hydrolysis of the fabric softening active.

One process for preparing a liquid fabric care composition, e.g., a liquid fabric softening composition, is a milling process. For example, molten organic premix of a fabric softener active, a front-end stability agent, and any other organic materials, except cationic polymer, and, preferably not perfume, is prepared and dispersed into a water seat comprising water at about 145-175° F. High shear milling is conducted at a temperature of about 140-160° F. A salt, e.g., calcium chloride, is then added in a range of from about 400 ppm to about 7,000 ppm as needed to control viscosity. If the mixture is too viscous to mill properly, salt can be added prior to milling to achieve a manageable viscosity. The dispersion is then cooled to ambient temperature and additional salt is added, typically in an amount of from about 600 ppm to about 8,000 ppm at ambient temperature. As a preferred method, perfume is added at ambient temperature before adding the additional salt.

Preferably, cationic polymer delivery enhancing agent is added to the dispersion after the dispersion has been cooled to ambient temperatures, e.g., 70-85° F. More preferably, the cationic polymer is added after ingredients such as soil release polymers and perfumes, and most preferably, the cationic polymer is added to the dispersion after the final addition of the salt.

Another process of making a liquid fabric softening composition is by batch-wise mixing the components of the composition using cavitation. Cavitation refers to the process of forming vapor bubbles in a liquid. This can be done in a number of manners, such as through the use of a swiftly moving solid body (as an impeller), hydrodynamically, or by high-frequency sound waves. When the bubbles collapse further downstream from the forming location, they release a certain amount of energy, which can be utilized for making chemical or physical transformations.

One particular method for producing hydrodynamic cavitation uses an apparatus known as a liquid "whistle". Liquid whistles are described in Chapter 12 "Techniques of Emulsification" of a book entitled Emulsions—Theory and Practice, 3rd Ed., Paul Becher, American Chemical Society and Oxford University Press, NY, N.Y., 2001. An example of a liquid whistle is a SONOLATOR® high pressure homogenizer, which is manufactured by Sonic Corp. of Stratford, Conn., U.S.A.

Continuous and semi-continuous processes using liquid whistles have been used for many years. The apparatuses have been used as in-line systems, single or multi-feed, to instantly create fine, uniform and stable emulsions, dispersions, and blends in the chemical, personal care, pharmaceutical, and food and beverage industries. Liquids enter the liquid whistle under very high operating pressures, in some cases up to 1000 bar. By operating pressure, it is understood to mean the pressure of the liquid(s) as it enters the liquid whistle device. This ensures efficient mixing of the liquids within the apparatus. Such operating pressures may be achieved by using, for example, a Sonolator® High Pressure Homogenizer. Lower operating pressures may be used, while achieving the same degree of mixing, by mixing a fabric softening active in liquid form with a second liquid composition using an apparatus comprising two or more orifices arranged in series.

The liquid fabric softening active portion of the composition comprises a fabric softening active, as described above, a front-end stability agent, as described above, and, optionally, a solvent. In some processes the front-end stability agent is added to the fabric softening active before the active is hydrated, e.g., mixed with a second, water-containing, liquid composition, as discussed below. In certain embodiments, the fabric softening active is present at a concentration between 85% and 95% by weight of the fabric softening active composition. A solvent selected from a low molecular weight (MW) alcohol such as ethanol or isopropanol, or mixtures thereof, can be present. In some embodiments, the liquid fabric softening active composition is added in a molten form. The liquid fabric softening active composition is preferably heated to a temperature between 70° C. and 90° C. in order to make it molten.

In a typical continuous, process using the "whistle" type apparatus, a second liquid composition used in the process comprises water (hence, it hydrates the liquid fabric softening active composition when the liquid fabric softening active and the second liquid composition pass through the whistle apparatus at the desired flow rate) and may also comprise any of the general types of adjunct materials that appear in liquid fabric softening compositions known in the art. For example, the second liquid composition may comprise various adjunct agents, including silicone compounds, perfumes, encapsulated perfumes, dispersing agents, stabilizers, colorants, brighteners, odor control agents, pro-perfumes, cyclodextrin, solvents, antimicrobial agents, chlorine scavengers, anti-shrinkage agents, fabric crisping agents, spotting agents, anti-oxidants, anti-corrosion agents, bodying agents, drape and form control agents, smoothness agents, static control agents, wrinkle control agents, sanitization agents, drying agents, stain resistance agents, soil release agents, malodor control agents, fabric refreshing agents, chlorine bleach odor control agents, dye fixatives, dye transfer inhibitors, color maintenance agents, color restoration/rejuvenation agents, anti-fading agents, whiteness enhancers, anti-abrasion agents, wear resistance agents, fabric integrity agents, anti-wear agents, defoamers and anti-foaming agents, rinse aids, insect repellents, anti-allergenic agents, enzymes, flame retardants, water proofing agents, fabric comfort agents, water conditioning agents, stretch resistance agents, chelants, or mixtures thereof. In one embodiment, the second liquid composition comprises silicone compounds. The second liquid composition may also be heated or unheated. In one embodiment, the temperature of the second liquid composition is between 40° C. and 70° C. The pH of the second liquid composition should be adjusted such that the final resultant liquid fabric softening composition has the desired pH (see above). The second liquid composition may be conveniently introduced into the apparatus through an inlet that is separate from the inlet used to introduce the softener active materials. The deposition enhancing agent is added after the aforesaid mixture cools to ambient temperature.

A continuous process of the foregoing type is further discussed in the U.S. patent application claiming the benefit of Provisional Application No. 61/294,533, now U.S. Ser. No. 12/984,663. An example of that process employs an apparatus comprising:

at least a first inlet and a second inlet; a pre-mixing chamber, the pre-mixing chamber having an upstream end and a downstream end, the upstream end of the pre-mixing chamber being in liquid communication with the first inlet and the second inlet; an orifice component, the orifice component having an upstream end and a downstream end, the upstream end of the orifice component being in liquid communication with the downstream end of the pre-mixing chamber, wherein the orifice component is configured to spray liquid in a jet and produce shear, turbulence and/or cavitation in the liquid; a secondary mixing chamber, the secondary mixing chamber being in liquid communication with the downstream end of the orifice component; at least one outlet in liquid communication with the secondary mixing chamber for discharge of liquid following the production of shear, turbulence and/or cavitation in the liquid, the at least one outlet being located at the downstream end of the secondary mixing chamber; the orifice component comprising at least two orifice units, arranged in series to one another and each orifice unit comprises an orifice plate comprising at least one orifice, an orifice chamber located upstream from the orifice plate and in liquid communication with the orifice plate; and wherein neighboring orifice plates are distinct from each other.

In the process, one or more suitable liquid pumping devices are connected to the first inlet and to the second inlet. A liquid fabric softening active composition is pumped into the first inlet, and a second liquid composition is pumped into the second inlet, wherein the operating pressure of the apparatus is between 0.1 bar and 50 bar, the operating pressure being the pressure of the liquid as measured in the pre-mix chamber; thereafter allowing the liquid fabric softening active and the second liquid composition to pass through the apparatus at a desired flow rate, wherein as they pass through the apparatus, they are dispersed one into the other. The resultant liquid fabric softening composition is removed from the outlet.

Examples

The following are non-limiting examples of the fabric care compositions of the present invention.

| (% wt) | I | II | III | IV | V |
|---|---|---|---|---|---|
| FSA[a] | 12 | 21 | 18 | 14 | 12 |
| FSA[b] | — | — | — | — | — |
| FSA[c] | — | — | — | — | — |
| Fatty Amphiliphile[##] | — | — | — | — | — |
| Low MW alcohol | 1.95 | 3.0 | 3.0 | 2.28 | 2.28 |
| Structurant[e,f] | 1.25[e] | — | 0.2[f] | — | 0.2[f] |
| Perfume | 1.50 | 2.3 | 2.0 | 1.50 | 1.50 |
| Perfume encapsulation | 0.6 | 0.3 | 0.4 | — | 0.15 |
| Suds Suppressor[h] | — | — | — | — | — |
| Calcium Chloride | 0.10 | 0.12 | 0.1 | 0.45 | 0.55 |
| DTPA[i] | 0.005 | 0.005 | 0.005 | 0.005 | 0.005 |
| Preservative (ppm)[j] | 5 | 5 | 5 | 5 | 5 |
| Antifoam[k] | 0.015 | 0.15 | 0.11 | 0.011 | 0.011 |
| Polyethylene imines[l] | 0.15 | 0.05 | — | 0.1 | — |
| Delivery enhancing agent[m] | 0.1 | 0.1 | 0.2 | 0.05 | 0.1 |
| PDMS emulsion[n] | — | 0.5 | 1 | 2.0 | — |
| Dispersant[o] | — | — | 0.5 | 0.2 | 0.2 |
| Organosiloxane polymer[p] | 5 | — | — | — | — |
| Amino-functional silicone | — | — | — | — | 5 |
| Front-end Stability Aid[q,r] | 0.06[q] | 0.63[r] | 0.36[q] | 0.14[r] | 0.12[r] |
| Dye (parts per million (ppm)) | 40 | 11 | 30 | 40 | 40 |
| Ammonium Chloride | | | | 0.10 | |
| Hydrochloric Acid | 0.010 | 0.01 | 0.10 | 0.010 | 0.010 |
| Deionized Water | Balance | Balance | Balance | Balance | Balance |

| (% wt) | VI | VII | VIII | IX | X |
|---|---|---|---|---|---|
| FSA[a] | 16 | 12 | — | — | 8 |
| FSA[b] | — | — | — | — | — |
| FSA[c] | — | — | 7 | — | — |
| FSA[d] | — | — | — | 12 | — |
| Fatty Amphiliphile[##] | — | — | — | — | 6 |
| Low MW alcohol | 1.50 | 2.68 | 0.9 | — | 1.2 |
| Structurant[e,f] | — | — | 0.70[e] | — | 0.15 |
| Perfume | 2.20 | 1.50 | 0.8-1.5 | 2.4 | 1.2 |
| Perfume encapsulation | 0.4 | 0.25 | — | — | 0.4 |
| Suds Suppressor[h] | — | — | 0.1 | — | 0.1 |
| Calcium Chloride | 0.350 | 0.545 | 0.1-0.15 | 0.05 | 0.2 |
| Chelant[i] | 0.005 | 0.007 | — | 0.05 | 0.05 |
| Preservative (ppm)[j] | 5 | 5 | 250 | 75 | 10 |
| Antifoam[k] | 0.011 | 0.011 | — | 0.005 | .01 |
| Polyethylene imines[l] | — | 0.1 | — | — | — |
| Delivery enhancing agent[m] | 0.1 | 0.1 | 0.1-0.2 | 0.1 | 0.15 |
| PDMS emulsion[n] | — | — | | — | 1.0 |
| Dispersant[o] | 0.1 | 0.2 | — | — | — |
| Organosiloxane polymer[p] | 2 | — | 0-5.0 | 3.0 | — |
| Amino-functional silicone | — | 2 | 0-5.0 | — | — |
| Front-end Stability Aid[q,r] | 0.48[r] | 0.09[q] | 0.2[r] | 0.3[q] | 0.15[q] |
| Dye (ppm) | 40 | 40 | 30-300 | 30-300 | 40 |
| Ammonium Chloride | 0.10 | 0.115 | — | — | — |
| Hydrochloric Acid | 0.010 | 0.010 | 0.025 | 0.01 | 0.2 |
| Deionized Water | Balance | Balance | Balance | Balance | Balance |

[a]N,N-di(tallowoyloxyethyl)-N,N-dimethylammonium chloride.

[b]Methyl bis(tallow amidoethyl)2-hydroxyethyl ammonium methyl sulfate.

[c]Reaction product of fatty acid with methyldiethanolamine in a molar ratio 1.5:1, quaternized with methylchloride, resulting in a 1:1 molar mixture of N,N-bis(stearoyl-oxy-ethyl) N,N-dimethyl ammonium chloride and N-(stearoyl-oxy-ethyl) N,-hydroxyethyl N,N dimethyl ammonium chloride.

[d]The reaction product of fatty acid with an iodine value of 40 with methyl/diisopropylamine in a molar ratio from about 1.86 to 2.1 fatty acid to amine and quaternized with methyl sulfate.

[e]Cationic high amylose maize starch-available from National Starch under the trade name HYLON VII ®.

[f]Cationic polymer available from BASF ® under the name Rheovis ® CDE.

[h]SILFOAM ® SE 39 from Wacker Chemie AG.

[i]Diethylene triamine pentaacetic acid.

[j]Koralone ™ B-119 available from Dow.

[k]Silicone antifoam agent available from Dow Corning ® under the trade name DC2310.

[l]Polyethylene imines available from BASF under the trade name Lupasol ®.

[m]Cationic acrylate acrylamide copolymer for example as described on page 16 to 17 of the present specification

[n]Polydimethylsiloxane emulsion from Dow Corning ® under the trade name DC346.

[o]Non-ionic such as TWEEN 20 ™ or cationic surfactant as Berol 648 and Ethoquad ® C 25 from Akzo Nobel.

[p]Organosiloxane polymer condensate made by reacting hexamethylenediisocyanate (HDI), and a, w silicone diol and 1,3-propanediamine, N'-(3-(dimethylamino)propyl)-N,N-dimethyl- Jeffcat Z130) or N-(3-dimethylaminopropyl)-N,Ndiisopropanolamine (Jeffcat ZR50) commercially available from Wacker Silicones, Munich, Germany.

[q]Fineoxocol ® 180 from Nissan Chemical Co.

[r]Isofol ® 16 from Sasol.

**For example PGE

Method of Making and Using Example I to X

Examples I to IX are made by combining the molten fabric softener active with the front-end stability agent to form a first mixture. This first mixture is combined with water and hydrochloric acid using a high shear mixing device to form a second mixture. The adjunct ingredients are combined with the second mixture using low shear mixing to form the fabric enhancing formula.

Example X is made by combining the molten fabric softener active, PGE and front-end stability agent to form a first mixture. This first mixture is combined with water and hydrochloric acid using a high shear mixing device to form a second mixture. The adjunct ingredients are combined with the second mixture using low shear mixing to form the fabric enhancing formula.

Examples I through X are used by dosing 10 to 60 g of the formula into the rinse liquor for example via dispensing into a cloths washing machine. Cloths are dried on a line or in an automated clothes dryer. The fabrics treated with these formulas have improved feel and scent.

Test Methods

Fabric softener formulations are prepared by combining water, hydrochloric acid, an antifoam agent, a preservative, and a chelant to form a first mixture; heating the first mixture to 70° C.; melting a fabric softener active and a front-end stability agent together to form a softener active and front-end stability agent melt; adding the softener active and front-end stability agent melt to the first mixture, using high shear mixing, to form a second mixture; adding $CaCl_2$ solution to the second mixture to form a third mixture; and cooling the third mixture to 25° C. using chilled water circulated through a cooling coil. This third mixture is referred to as the softener base. Phase stabilizing polymer, dye, perfume and encapsulated perfume are added to the softener base, using overhead mixing at room temperature, to form the finished product.

Table 1 shows the Brookfield viscosities of different fabric softener formulations, including both softener bases and finished products, 24 hours and 8 weeks after storage at ambient laboratory temperature. The data demonstrate that the viscosities of softener bases containing the front-end stability agents of the invention are reduced, as compared to the viscosities of comparative softener bases, which do not contain the front-end stability agents of the invention. This indicates that the addition of the front-end stability agent to the fabric softener active, as described above, modifies the microstructure of the softener base. It is believed that the addition of front-end stability agent to fabric softener active results in smaller vesicles of softener active, thereby creating more space for phase stabilizing polymers, dyes, perfumes, encapsulated perfumes, and other later-added components.

The type of front-end stability agent and concentration of front-end stability agent are the only variables in the different formulations of Table 1. Samples 1 through 10 represent compositions containing the front-end stability agents of the present invention, while samples 11 through 17 represent comparative compositions containing no front-end stability agent or materials that do not function as front-end stability agents.

Data

TABLE 1

Effects of Front-end Stability Agents on Viscosities of Softener Formulations

| Sample | Material | Concentration of Front-end Stability Agent (as wt. % of softener) | Brookfield Viscosity (cPs) | | | |
|---|---|---|---|---|---|---|
| | | | Softener Base | | Finished Product | |
| | | | 24 hr. | 8 weeks | 24 hr. | 8 weeks |
| 1 | 2-hexyl-1-decanol (Isofol[2] ® 16) | 2% | 22 | 19 | N/A[1] | 107 |
| 2 | Isofol ® 18E | 2% | 23 | 37 | 55 | 148 |
| 3 | 2-octyl-1-dodecanol (Isofol ® 20) | 2% | 30 | 45 | 60 | 151 |
| 4 | iso-stearyl alcohol with branching on the second carbon (Fineoxocol ® 180[3]) | 1% | 35 | 33 | 80 | 143 |
| 5 | 2-hexyl-1-decanoic acid (Isocarb[4] ® 16) | 1% | 44 | 43 | N/A | 223 |
| 6 | a mixture of branched C16-17 alcohols (Neodol ™ 67[5]) | 2% | 55 | 47 | 110 | 208 |
| 7 | 2-hexyl-1-decanol (Isofol ® 16) | 1% | 57 | 45 | 104 | 195 |
| 8 | 2-butyl-1-octanol (Isofol ® 12) | 1% | 74 | 60 | 110 | 198 |
| 9 | 2-ethyl-1-hexanol | 2% | 69 | 58 | 95 | 228 |
| 10 | mixture of branched C12-13 alcohols (Isalchem ® 123[6]) | 2% | 88 | 138 | 128 | 401 |
| 11 (comparative) | Cyclohexanol | 2% | 100 | 152 | 450 | 940 |
| 12 (comparative) | Bardac ® 2280[7] | 2% | 110 | 4550 | 1,440 | 2,280 |
| 13 (comparative) | 2-decyltetradecanol (Isofol ® 24) | 1% | 112 | 114 | 253 | 458 |

TABLE 1-continued

Effects of Front-end Stability Agents on Viscosities of Softener Formulations

| Sample | Material | Concentration of Front-end Stability Agent (as wt. % of softener) | Brookfield Viscosity (cPs) Softener Base 24 hr. | Softener Base 8 weeks | Finished Product 24 hr. | Finished Product 8 weeks |
|---|---|---|---|---|---|---|
| 16 (comparative) | oleyl alcohol | 2% | 204 | 167 | 307 | 802 |
| 17 (comparative) | CO-1214[8] | 1% | 276 | 1300 | 568 | 2,250 |
| 20 (comparative | none | 0% | 202 | 330 | 330 | 680 |

[1]N/A-Brookfield viscosity was not measured.
[2]ISOFOL ® alcohols are available from Sasol.
[3]Fineoxocol ® 180 is available from Nissan Chemical Co.
[4]ISOCARB ® acids are available from Sasol.
[5]NEODOL ™ alcohols are available from Shell Chemicals.
[6]ISALCHEM ® 123 alcohols are available from Sasol.

[7] 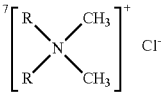

Where R = n-decyl

BARDAC ® 2280 quaternary ammonium compounds are available from Lonza Inc.

[8]$C_{12/14}H_{2n+1}OH$; $n$ = 10, 12. CO-1214 is a mixture of lauryl, myristyl, adn cetyl alcohols. CO-1214 is available from P&G Chemicals.

TABLE 2

Effect of Varying Concentrations of Front-end Stability Agents on Viscosity

| Sample | Material | Concentration of Front-end Stability Agent (as wt. % of softener) | Brookfield Viscosity (cPs) Softener Base 24 hr. | Softener Base 8 weeks | Finished Product 24 hr. | Finished Product 8 weeks |
|---|---|---|---|---|---|---|
| 1 | Isofol ® 16 | 1% | 11 | 14 | 26 | 86 |
| 2 | | 4% | 18 | 15 | 38 | 374 |
| 3 | | 6% | 18 | 17 | 45 | 400 |
| 4 | | 10% | 184 | 139 (2 weeks[1]) | 212 | 500+ (gel) |
| 5 | Propyl-1- | 1% | 12.5 | 11 | 28 | 67 |
| 6 | heptanol | 2% | 14.5 | 15 | 35 | 111 |
| 7 | | 10% | 62 | 347 | 500+ (gel) | 500+ (gel) |

[1]The Brookfield viscosity of certain samples was measured at 2 weeks instead of 8 weeks.

Table 2 shows the effects of varying the concentrations of front-end stability agents on the viscosity of softener base and finished product, at 24 hours, 2 weeks, and 8 weeks. Samples 2 through 8 represent compositions containing the front-end stability agents of the present invention, while sample 1 contains no front-end stability agent.

The undesirable effects of materials such as cyclohexanol and oleyl alcohol are noted and the compositions are preferably free of such materials. The negative effects of excessive amounts of even the branch heptanol alcohol are noteworthy. Clearly, the benefit of the low level of front-end stability agent is not due to a solvent effect.

It has now been discovered that cross-linking the various polymers of the type disclosed above may provide improved deposition of fabric softener actives, especially hydrogenated DEEDMAC, as discussed hereinafter. See U.S. Provisional Application 61/501,426, filed Jun. 27, 2011. Various agents can be used to cross-link delivery enhancing polymers. Non-limiting examples of cross-linkers include ethylene glycoldi-acrylate, divinylbenzene and butadiene.

Useful cross-linked delivery enhancing agent polymers include cross-linked homo- and co-polymers selected from the group consisting of: acrylamides; acrylates; methacrylates; methacrylamides; and the cationic derivatives thereof. Cationic methacrylate cross-linked homopolymers are especially useful herein. Such materials include RHEOVIS CDE (BASF) and FLOSOFT 222 (SNF Floerger) and can be used in any of the compositions exemplified herein.

It has also been determined that it may be desirable to employ hardened tallow-based fabric softeners, inasmuch as fabric softening actives that are highly unsaturated can develop off-odors on aging. Accordingly, tallow fatty acids that are "hardened," i.e., hydrogenated, to provide such hardened tallow softening actives that comprise tallow fatty acids having Iodine Values less than about 20 are preferred herein. As especially preferred, "di-hardened" tallow fabric softening active comprises a di-(hydrogenated tallowoyl oxyethyl) dimethyl ammonium chloride, i.e., "hydrogenated DEEDMAC" (or methylsulfate) having an average chain length of the fatty acid moieties of from about 16 to about 18 and an IV, calculated for the free fatty acid that is below 20, preferably 0 to about 15, e.g., N,N-dimethyl-N,N-bis-(stearoyl oxyethyl) ammonium chloride or methylsulfate.

Unfortunately, the use of such "hardened" softening actives can be problematic, since they tend to have unacceptably high viscosities when present with water at concentrations above about 15%, by weight. At such concentrations they are difficult to pour and even to pump during a fabric softener manufacturing process on a commercial scale.

Quite surprisingly, it has now been determined that the front-end stability agents, used as disclosed herein, allow for the preparation of softening active concentrates comprising more than about 15% of the N,N-dihardened tallow type of fabric softener actives. Since such concentrates can be formulated in a preferred viscosity range of about 30-300 centipoise, more preferably from about 50 to about 200 centipoise (cps), they can be used in a manufacturing operation as pumpable concentrates or marketed as "low dose" concentrates to the end user. Such concentrates can comprise, for example, from about 17% to about 40% hydrogenated DEEDMAC, by weight of composition. Of course, such concentrates provide a substantial savings in shipping and packaging costs.

Preferred compositions containing "hardened" softeners comprise:

a. a hydrogenated tallow-based cationic fabric softening active, comprising a dimethyl di-(hydrogenated tallowoyloxyethyl) ammonium salt, especially hydrogenated DEEDMAC, preferably at a level of at least about 15%, more preferably greater than about 15% by weight of the composition;

b. a front-end stability agent; and c. a cross-linked deposition enhancing agent; and d. an aqueous carrier.

Preferably, such hydrogenated DEEDMAC compositions comprise from about 0.5% to about 4%, by weight of said softening active, of a stability-enhancing agent selected from the group consisting of $C_8$-$C_{20}$ branched-chain alcohols, $C_8$-$C_{20}$ branched chain carboxylic acids or their water soluble salts, and mixtures thereof. The deposition enhancing agent comprises one or more cross-linked polymers selected from the group consisting of acrylamides, acrylates, methacrylates, methacrylamides, cationic derivatives of said polymers, and mixtures thereof, typically at levels from about 0.02% to about 3%, by weight of the composition. Table 3 describes non-limiting examples of such composition.

TABLE 3

| Wt. %* | $A_1$ | $A_2$ | $A_3$ | $A_4$ |
|---|---|---|---|---|
| Fabric Softening Active[1] | 15.8 | 17.0 | 17.5 | 20.0 |
| Rheovis CDE* | 0.50* | — | 0.075 | 0.20 |
| Flosoft 222* | — | 0.30* | 0.025 | — |
| Isofol ® 16* | 2.0* | — | — | — |
| Fineoxocol ®180 (Nissan)* | — | — | 0.25* | 3* |
| 2-hexyl-1-decanoic acid* | — | — | 0.25* | — |
| Neodol ® 67* | — | 2.0* | — | — |
| Low MW Alcohol[2] | 1.9 | 2.2 | 2.0 | 2.4 |
| Calcium Chloride | 0.15 | 0.13 | 0.16 | 0.2 |
| DTPA[3] | 0.005 | 0.006 | 0.005 | 0.008 |
| Preservative[4] (ppm) | 5 | 4.5 | 5.0 | 4.0 |
| Antifoam[5] | 0.15 | 0.17 | 0.15 | 0.20 |
| Perfume | 1.7 | 1.2 | 1.8 | 1.75 |
| Encapsulated Perfume | 0.6 | 0.6 | 0.45 | 0.7 |
| Dye (ppm) | 40 | 42 | 50 | 50 |
| PDMS Emulsion[6] | — | 0.5 | 0.66 | 0.68 |
| Hydrochloric Acid | 0.01 | 0.01 | 0.015 | 0.017 |
| Deionized Water | Balance | Balance | Balance | Balance |

[1]N,N-di(tallowoyloxyethyl)-N,N-dimethylammonium chloride, hardened to IV less than about 20, preferably less than about 15.
[2]Ethanol or mixture of ethanol and isopropanol.
[3]Diethylene triamine pentacetic acid.
[4]Koralone ™ B-119 available from Dow.
[5]Silicone antifoam agent available from Dow Corning ® under the trade name DC2310.
[6]Polydimethylsiloxane emulsion from Dow Corning ® under the trade name DC346. Sodium salt may be substituted for acid.
*The percentage of front-end stability agent is by weight of the fabric softening active. All other percentages are by weight of composition.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric care composition comprising:

a) from about 1.5% to about 50% by weight of the composition of a fabric softening active;

b) from about 0.5% to about 6% by weight of the fabric softening active of a front-end stability agent selected from saturated branched alcohols comprising 8 to about 20 carbon atoms, 2-hexyl-1-decanoic acid, the salts of said acid, and mixtures thereof;

c) a delivery enhancing agent.

2. The fabric care composition of claim 1 wherein the fabric softening active is a quaternary ammonium compound.

3. The fabric care composition of claim 1 wherein the concentration of front-end stability agent is about 0.5% to about 4% by weight of the fabric softening active.

4. The fabric care composition of claim 1 wherein the concentration of front-end stability agent is about 0.5% to about 2% by weight of the fabric softening active.

5. The fabric care composition of claim 1 wherein the concentration of front-end stability agent is about 0.5% to about 1.5% by weight of the fabric softening active.

6. The fabric care composition of claim 1 wherein the delivery enhancing agent is a cationic polymer with a net cationic charge density of from about 0.05 meq/g to about 23 meq/g.

7. The fabric care composition of claim 1 wherein said composition comprises from about 0.01% to about 8% by weight of the composition of said delivery enhancing agent.

8. The fabric care composition of claim 7 wherein said delivery enhancing agent is a cationic polymer having a weight-average molecular weight of from about 3000 to about 10,000,000.

9. The fabric care composition of claim 8 wherein said delivery enhancing agent is selected from cationic acrylic based homopolymers, poly(acrylamide-N-dimethyl aminoethyl acrylate) and its quaternized derivatives, poly(acrylamide-N-dimethyl aminoethyl methacrylate) and its quaternized derivatives, polyethyleneimine, or mixtures thereof.

10. A composition according to claim 8 wherein the delivery enhancing agent comprises poly(N-dimethyl amino ethyl methacrylate).

11. The fabric care composition of claim 1 wherein the front-end stability agent is selected from 2-ethyl-1-hexanol, 2-butyl-1-octanol, 2-hexyl-1-decanol, 2-octyl-1-decanol, 2-octyl-1-dodecanol, a mixture of branched C16-17 alcohols, iso-stearyl alcohol with branching on the second carbon, a mixture of branched C12-13 alcohols, 2-hexyl-1-decanoic acid, and mixtures thereof.

12. The fabric care composition of claim 1 wherein the fabric softening active is bis-(2 hydroxyethyl)-dimethylammonium chloride fatty acid ester having an average chain length of the fatty acid moieties of from 16 to 20 carbon atoms and an Iodine Value (IV), calculated for the free fatty acid, of from 15 to 25, wherein the front-end stability agent is selected from 2-ethyl-1-hexanol, 2-butyl-1-octanol, 2-hexyl-1-decanol, 2-octyl-1-decanol, 2-octyl-1-dodecanol, a mixture of branched C16-17 alcohols, iso-stearyl alcohol with branching on the second carbon, a mixture of branched C12-13 alcohols, 2-hexyl-1-decanoic acid, and mixtures thereof, and wherein the delivery enhancing agent is selected from cationic acrylic based homopolymers, poly(acrylamide-N-dimethyl aminoethyl acrylate) and its quaternized derivatives, poly(acrylamide-N-dimethyl aminoethyl methacrylate) and its quaternized derivatives, and mixtures thereof.

13. The fabric care composition of claim 1 comprising from about 0.5% to about 3.0% of neat perfume by weight of the fabric care composition.

14. The fabric care composition of claim 1 comprising from about 0.25% to about 5% by weight of the fabric care composition of a silicone.

15. A method of providing a benefit to a fabric comprising contacting the fabric care composition of claim 1.

16. A method of making a fabric care composition according to claim 1 comprising the steps of:

a. mixing a molten fabric softening active with a front end stability agent to form a first mixture;
b. combining the first mixture with acidified water and a delivery enhancing agent; and
c. optionally, adding one or more adjunct agents to said composition.

17. A fabric care composition according to claim 1 comprising:

a. from about 1.5% to about 30% by weight of the composition of a cationic fabric softening active having two or more alkyl or alkenyl chains each having an average chain length of the fatty acid moieties of from 8 to 20 carbon atoms and an Iodine Value (IV), calculated for the free fatty acid, of from 0 to 40;
b. from about 0.5% to about 6%, by weight of said softening active, of a front-end stability agent selected from saturated branched alcohols having a chain length of 8 to 20 carbon atoms or saturated branched carboxylic acids, or salts thereof, having a chain length of 8 to 20 carbon atoms, or mixtures thereof;

wherein the fabric care composition has a major phase transition peak of more than 54° C.

18. A fabric care composition according to claim 1 comprising:

a) from about 1.5% to about 50%, by weight of the composition cationic, of a fabric softening active having two or more alkyl or alkenyl chains each having an average chain length of the fatty acid moieties of from 8 to 20 carbon atoms and an Iodine Value (IV), calculated for the free fatty acid, of from 25-40; and
b) from about 0.5% to about 6%, by weight of said softening active, of a front-end stability agent selected from saturated branched alcohols having a chain length of 8 to 20 carbon atoms or saturated branched carboxylic acids having a chain length of 8 to 20 carbon atoms, or salts of said acids, or mixtures thereof.

19. A fabric softener composition according to claim 1, comprising:

a. a hydrogenated tallow-based cationic fabric softening active, comprising a dimethyl di-(hydrogenated tallowoyloxyethyl) ammonium salt;
b. a front-end stability agent;
c. a cross-linked deposition enhancing agent; and
d. an aqueous carrier.

20. A composition according to claim 19, comprising at least about 15%, by weight of the composition, of said hydrogenated fabric softening active.

21. A concentrated composition according to claim 20, comprising greater than 15%, by weight of the composition, of hydrogenated DEEDMAC.

22. A composition according to claim 21, comprising from about 0.5% to about 4%, by weight of said softening active, of a stability-enhancing agent selected from the group consisting of $C_8$-$C_{20}$ branched alcohols, $C_8$-$C_{20}$ branched carboxylic acids or their water soluble salts, and mixtures thereof.

23. A composition according to claim 1 comprising a fatty amphiphile.

24. A fabric care composition comprising:

a) from about 1.5% to about 50% by weight of the composition of a fabric softening active;
b) from about 0.5% to about 6% by weight of the fabric softening active of a front-end stability agent selected from saturated branched alcohols comprising about 8 to about 20 carbon atoms or a member selected from the group consisting of saturated branched carboxylic acids comprising about 8 to about 20 carbon atoms, or the salts of said acids, and mixtures thereof;
c) a delivery enhancing agent wherein said delivery enhancing agent is a cationic polymer having a weight-average molecular weight of from about 3000 to about 10,000,000 that comprises crosslinked poly(N-dimethyl amino ethyl methacrylate).

25. A composition comprising:

a) from about 1.5% to about 50% by weight of the composition of a fabric softening active; that comprises a hydrogenated tallow-based cationic fabric softening active, comprising a dimethyl di-(hydrogenated tallowoyloxyethyl) ammonium salt; said hydrogenated tallow-based cationic fabric softening active, comprising a dimethyl di-(hydrogenated tallowoyloxyethyl) ammonium salt; said composition comprising greater than 15%, by weight of the composition, of hydrogenated DEEDMAC;
b) from about 0.5% to about 4%, by weight of said softening active, of a stability-enhancing agent selected from the group consisting of C8-C20 branched alcohols, C8-C20 branched carboxylic acids or their water soluble salts, and mixtures thereof;
c) a cross-linked deposition enhancing agent comprising one or more cross-linked polymers selected from the group consisting of acrylamides, acrylates, methacrylates, methacrylamides, cationic derivatives of said polymers, and mixtures thereof;
d) an aqueous carrier.

* * * * *

UNITED STATES PATENT AND TRADEMARK OFFICE

CERTIFICATE OF CORRECTION

PATENT NO. : 8,709,992 B2
APPLICATION NO. : 13/433326
DATED : April 29, 2014
INVENTOR(S) : Barnabas et al.

It is certified that error appears in the above-identified patent and that said Letters Patent is hereby corrected as shown below:

In the Claims:

Column 35

Line 24, insert -- with the fabric -- after fabric.

Signed and Sealed this
Fifteenth Day of July, 2014

Michelle K. Lee

Michelle K. Lee
*Deputy Director of the United States Patent and Trademark Office*